US008680782B2

(12) United States Patent
Sakuragi et al.

(10) Patent No.: US 8,680,782 B2
(45) Date of Patent: Mar. 25, 2014

(54) LIGHT-EMITTING DIODE DRIVING APPARATUS

(71) Applicant: Nichia Corporation, Anan (JP)

(72) Inventors: Harumi Sakuragi, Tokushima (JP); Wataru Ogura, Okaya (JP); Teruo Watanabe, Okaya (JP); Minoru Kitahara, Okaya (JP)

(73) Assignee: Nichia Corporation, Anan-shi (JP)

( * ) Notice: Subject to any disclaimer, the term of this patent is extended or adjusted under 35 U.S.C. 154(b) by 0 days.

(21) Appl. No.: 13/756,585

(22) Filed: Feb. 1, 2013

(65) Prior Publication Data

US 2013/0200802 A1 Aug. 8, 2013

(30) Foreign Application Priority Data

Feb. 3, 2012 (JP) ..... 2012-022525

(51) Int. Cl.
*G05F 1/00* (2006.01)

(52) U.S. Cl.
USPC ..... 315/291; 315/307; 315/185 S; 315/312; 315/224

(58) Field of Classification Search
USPC ..... 315/185 S, 247, 291, 312, 307
See application file for complete search history.

(56) References Cited

U.S. PATENT DOCUMENTS 8,471,495 B2 * 6/2013 Muguruma et al. ..... 315/299
2011/0199003 A1 8/2011 Muguruma et al.

FOREIGN PATENT DOCUMENTS

JP 2006-147933 6/2006
JP 2011-40701 2/2011

* cited by examiner

*Primary Examiner* — Tuyet Thi Vo
(74) *Attorney, Agent, or Firm* — Ditthavong Mori & Steiner, P.C.

(57) ABSTRACT

An apparatus includes first and fourth bypasses, a current detector, and a current controller. The first bypass is connected serially to a first LED, and controls the current amount in the first LED. The fourth bypass is connected serially to a second LED, and controls the current amount in the first and second LEDs. The detector detects current detection signal based on the current amount on an output line along which the first and second LEDs are connected serially to each other. The controller provides control signal for controlling the first and fourth bypasses based on the detection signal. The controller includes one output for providing the control signal. The first and fourth bypasses are connected in parallel to the one output.

10 Claims, 19 Drawing Sheets

LIGHT-EMITTING DIODE DRIVING APPARATUS

BACKGROUND OF THE INVENTION

1. Field of the Invention

The present invention relates to a driving circuit that drives light emitting diodes, and in particular to a light-emitting diode driving apparatus that drives light emitting diodes by using AC power supply.

2. Description of the Related Art

In recent years, significant attention is given to light emitting diodes (hereinafter, occasionally referred to as "LEDs") as lighting sources. The reason is that LEDs can be driven at low power consumption as compared with filament lamps or fluorescent lamps. LEDs are small, and have shock resistance. In addition, LEDs are less prone to blow out. Thus, LEDs have these advantages.

In the case of lighting sources, it is desirable that commercial AC power for home use is used as power supply for lighting sources. However, LEDs are devices driven by DC power. LEDs emit light only when applied with a current in the forward direction. Also, in the case of LEDs that are currently typically used for lighting use, the LEDs operate on DC power at a forward directional voltage $V_f$ of about 3.5 V. LEDs do not emit light if a voltage applied to the LEDs does not reach $V_f$. On the other hand, after a voltage applied to the LEDs exceeds $V_f$, an excessive amount of current may flow through the LEDs. Accordingly, it can be said that DC power is suitable for driving LEDs.

To satisfy the contradictory conditions, various types of LED driving circuits have been proposed which use AC power. For example, a method has been proposed which switches LEDs so that a $V_f$ total value is changed in accordance with a varying voltage value (see Japanese Patent Laid-Open Publication No. JP 2006-147,933 A). In this method, a number of LEDs connected to each other in series are assigned to blocks 161, 162, 163, 164, 165 and 166 as shown in a circuit diagram of FIG. 14. The LED blocks 161 to 166 are selectively connected to the power supply in accordance with the voltage value of input voltage of rectified waveform by a switch control portion 167 consisting of a microcomputer so that a Vf total value is changed in a stepped manner. As a result, as shown by a voltage waveform in a timing chart of FIG. 15, since the LEDs can be driven by a plurality of rectangular waves corresponding to the rectified waveform, the LED operation efficiency can be improved as compared with the ON-duty in the case of only single rectangular wave.

On the other hand, the applicant has been developed an AC multi-stage circuit which includes a plurality of serially-connected LED blocks operated by an AC current after full-wave rectification, each of the plurality of LED blocks having a plurality of serially-connected LEDs (Japanese Patent Laid-Open Publication No. JP 2011-40,701 A). As shown in FIG. 16, this AC multi-stage circuit 1600 subjects a current from an AC power supply AP to full-wave rectification in a bridge circuit 1602 so that the LED blocks of multi stages are supplied with the current after the full-wave rectification. As the LED blocks of multi stages, first, second and third LED blocks 1611, 1612 and 1613 are serially connected to each other. A first LED current control transistor 1621A is turned ON/OFF to connect/disconnect a first bypass BP1601, which bypasses the second LED block 1612, based on the current amount in the first LED block 1611. A second LED current control transistor 1622A is turned ON/OFF to connect/disconnect a second bypass BP1602, which bypasses the third LED block 1613, based on the current amount in the first and second LED blocks 1611 and 1612. When the third LED current control transistor 1623A is turned from ON to OFF, a current cannot flow through a third bypass path BP1603, which bypasses an LED current restriction resistor 1603A. As a result, a current starts flowing through the LED current restriction resistor 1603A. The AC multi-stage circuit 1600 can keep power supply efficiency high, and additionally improve the use efficiency and the power factor of LEDs.

This light-emitting diode driving apparatus includes first, second and third current detection transistors 1631A, 1632A, and 1633A that are used to control ON/OFF of the first, second and third LED current control transistor 1621A, 1622A, and 1623A, respectively. Accordingly, the parts count will increase, and the circuit construction will be complicated.

On the other hand, since the first, second and third current detection transistors 1631A, 1632A, and 1633A are independently activated, it is necessary to precisely adjust the activation points of the first, second and third current detection transistors 1631A, 1632A, and 1633A to switch the first, second and third current detection transistors 1631A, 1632A, and 1633A at proper timing. In particular, noise and the like may cause activation timing point variation. For this reason, it is not easy to design the circuit with high reliability.

The present invention is devised to solve the above problems. It is a main object of the present invention to provide a light-emitting diode driving apparatus that can switches driving circuit activation at proper timing by using a simple circuit.

SUMMARY OF THE INVENTION

To achieve the above object, a light-emitting diode driving apparatus according a first aspect of the present invention includes a rectifying circuit, a first LED portion, a second LED portion, a first bypass portion, a fourth bypass portion, a current detection portion, and a current control portion. The rectifying circuit can be connected to AC power supply AP and rectifies an AC voltage of the AC power supply AP to provide a rectified voltage. The first LED portion is connected in series to the output-side of the rectifying circuit, and includes at least one LED device. The second LED portion is connected in series to the first LED portion, and includes at least one LED device. The first bypass portion is connected in series to the first LED portion and in parallel to the second LED portion, and controls the flowing current amount in the first LED portion. The fourth bypass portion is connected in series to the second LED portion, and controls the flowing current amount in the first and second LED portions. The current detection portion detects a current detection signal based on the flowing current amount on an output line OL along which the first and second LED portions and are connected in series to each other. The current control portion provides an operation control signal for controlling operation of the first and fourth bypass portions and based on the current detection signal, which is detected by the current detection portion. The current control portion includes one output for providing the operation control signal. The first and fourth bypass portions are connected in parallel to the one output.

According to this construction, the first bypass portion and the fourth bypass portion can be controlled by common operation control signals from the common current control portion. Therefore, the driving circuit for the light emitting diodes can be simplified. In addition, since the current control portion commonly operates, the driving circuit can have improved noise resistance. As a result, the driving circuit can stably operate. Therefore, the driving circuit can be reliable.

In a light-emitting diode driving apparatus according a second aspect of the present invention, the current control portion can use the rectified voltage, which is rectified by the rectifying circuit, as a reference voltage to provide the operation control signal for controlling operation of the first and fourth bypass portions.

According to this construction, the amount of current on the output line that is detected by the current detection portion can be adjusted to a value that is proportional to the rectified voltage. As a result, the input current of the entire circuit can be a waveform that is proportional to the AC input voltage. Therefore, it is possible to suppress harmonic components.

In a light-emitting diode driving apparatus according a third aspect of the present invention, a voltage variation suppression signal generation portion can be further provided. The voltage variation suppression signal generation portion is connected in series to the in-series circuit of the first and second LED portions and detects rectified voltage variation. The current control portion can control operation of the first and fourth bypass portions based on the sum of the average value of the rectified voltage variation, which is detected by the voltage variation suppression signal generation portion, and the current detection signal, which is detected by the current detection portion. By employing such configuration, it can reduce the variation of light output cause by average power source voltage, by increasing a current flowing the first and second LED portion when the rectified average voltage is lower, and by reducing a current flowing the first and second LED portion when the rectified average voltage is higher.

In a light-emitting diode driving apparatus according a forth aspect of the present invention, a first charging/discharging capacitor can be further provided. The first charging/discharging capacitor is connected in parallel to the in-series circuit of the first and second LED portions.

According to this construction, the charging/discharging capacitor can reduce light OFF periods of the first and second LED portions. Namely, when the rectified voltage becomes high, a current flows in the first and second LED portions, while the charging/discharging capacitor can be charged. On the other hand, when the rectified voltage becomes low, a discharging current can flow from the charging/discharging capacitor to the first and second LED portions. As a result, it is possible to eliminate non-light-emission periods. Therefore, it is possible to provide quality lighting.

In a light-emitting diode driving apparatus according a fifth aspect of the present invention, a third LED portion and a second bypass portion can be further provided. The third LED portion is connected to the second LED portion, and includes at least one LED device. The second bypass portion is connected in series to the second LED portion and in parallel to the third LED portion, and controls the flowing current amount in the first and second LED portions. The first, second and fourth bypass portions can be connected in parallel to each other. The operation of the second bypass portion can be controlled by the current control portion. The fourth bypass portion can control the flowing current amount in first, second and third LED portions.

According to this construction, in addition to the first bypass portion and the fourth bypass portion, the second bypass portion can be controlled by the common current control portion. Therefore, the driving circuit can be further simplified.

In a light-emitting diode driving apparatus according a sixth aspect of the present invention, the current control portion can include an operational amplifier.

According to this construction, the circuit structure can be simplified. In addition, operation of the first and fourth bypass portions can be reliably switched. Also, it is possible to accurately adjust the amount of current on the output line to a value that is proportional to the rectified voltage.

In a light-emitting diode driving apparatus according a seventh aspect of the present invention, current control signal generation portions can be connected between the current control portion and the first bypass portion, and between the current control portion and the fourth bypass portion.

According to this construction, operation of the first and fourth bypass portions can be reliably switched.

In a light-emitting diode driving apparatus according an eighth aspect of the present invention, the current control signal generation portion can be a Zener diode or a resistor.

According to this construction, since a voltage difference will be produced between the operation control signals that are applied to the first and fourth bypass portions, operation of the first and fourth bypass portions can be reliably switched.

In a light-emitting diode driving apparatus according a ninth aspect of the present invention, an LED driving portion can be further provided. The LED driving portion is connected in series to the second LED portion, and controls the current flow in the first and second LED portions. The fourth bypass portion can be connected in parallel to the LED driving portion.

According to this construction, it is possible to limit the flowing current amount in the first and second LED portions. In addition to this, it is possible to reduce the load on the fourth bypass portion.

In a light-emitting diode driving apparatus according a tenth aspect of the present invention, the current control portion can be driven with constant-voltage power supply.

The above and further objects of the present invention as well as the features thereof will become more apparent from the following detailed description to be made in conjunction with the accompanying drawings.

DETAILED DESCRIPTION OF THE EMBODIMENT(S)

The following description will describe embodiments according to the present invention with reference to the drawings. It should be appreciated, however, that the embodiments described below are illustrations of a light-emitting diode driving apparatus used therein to give a concrete form to technical ideas of the invention, and a light-emitting diode driving apparatus of the invention is not specifically limited to description below. Furthermore, it should be appreciated that the members shown in claims attached hereto are not specifically limited to members in the embodiments. Unless otherwise specified, any dimensions, materials, shapes and relative arrangements of the parts described in the embodiments are given as an example and not as a limitation. Additionally, the sizes and the positional relationships of the members in each of drawings are occasionally shown larger exaggeratingly for ease of explanation. Members same as or similar to those of this invention are attached with the same designation and the same reference signs, and their description is omitted. In addition, a plurality of structural elements of the present invention may be configured as a single part that serves the purpose of a plurality of elements, on the other hand, a single structural element may be configured as a plurality of parts that serve the purpose of a single element. Also, the description of some of examples or embodiments may be applied to other examples, embodiments or the like.

In order that a light-emitting diode driving apparatus may meet the harmonic current standard, it is desired to flow a current having a current waveform of sine wave similar to filament lamps. According to the light-emitting diode driving apparatuses of embodiments of the present invention, a sine wave is applied as a reference voltage to an LED current control portion so that the waveform of LED driving current in brought to a waveform approximating a sine wave. Thus, the light-emitting diode driving apparatus can be provided which is inexpensive and compact, and meets the harmonic current standards for apparatuses of larger than 25 W.

First Embodiment

Figure 1A:
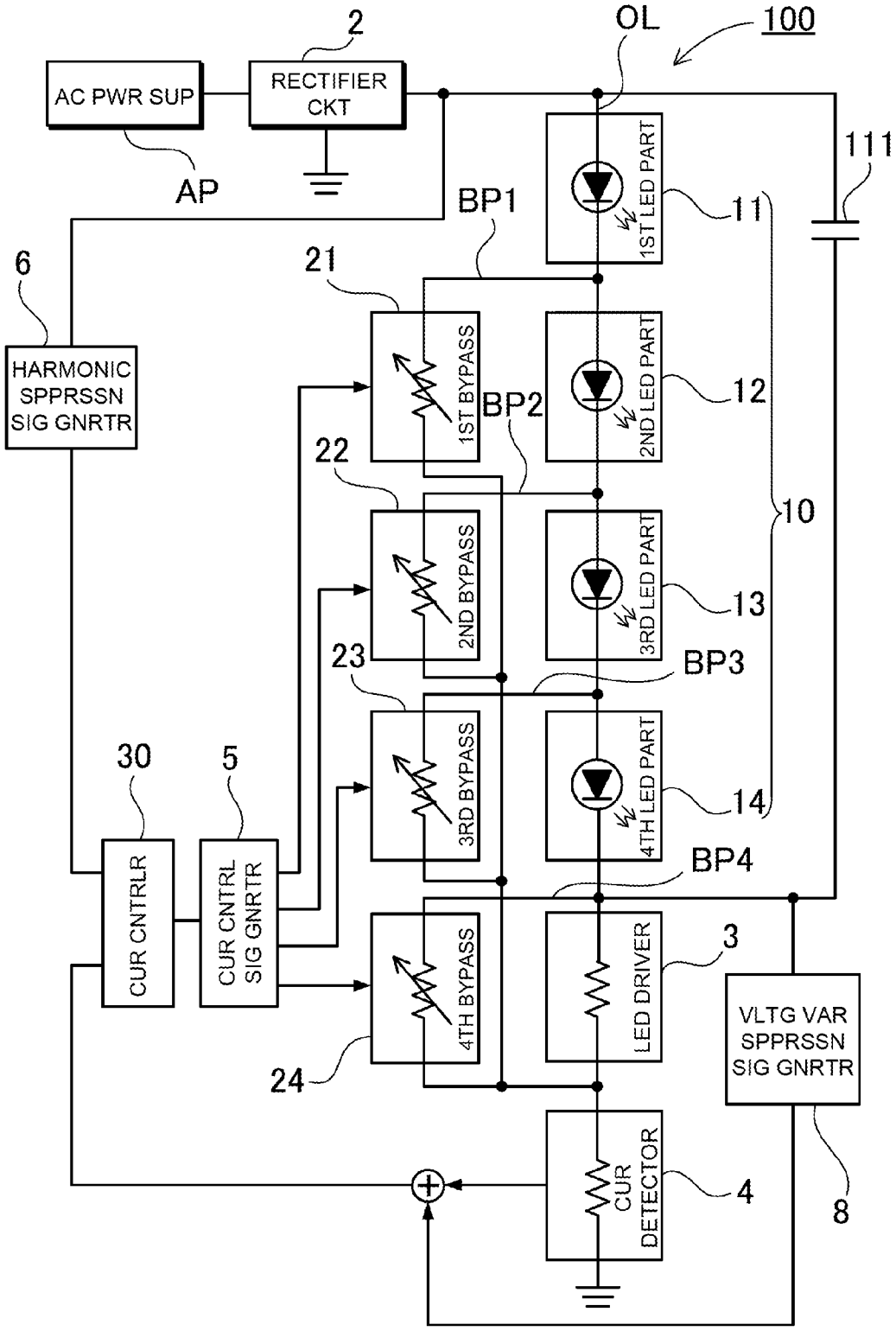
FIG. 1A is a block diagram showing a light-emitting diode driving apparatus according to a first embodiment.

FIG. 1A is a block diagram showing a light-emitting diode driving apparatus 100 according to a first embodiment. The light-emitting diode driving apparatus 100 includes a rectifying circuit 2, an LED unit 10, first to fourth bypass portions 21 to 24, a current control portion 30, and a current detection portion 4. In the light-emitting diode driving apparatus 100, the rectifying circuit 2, and the LED unit 10 are serially connected to each other through an output line OL. The rectifying circuit 2 is connected to AC power supply AP, and obtains a rectified voltage (pulsating voltage) by rectifying an AC voltage. The LED unit 10 includes a plurality of LED portions. In this embodiment, four LED portions are used as first, second, third and fourth LED portions 11, 12, 13 and 14, which are serially connected to each other. Thus, the first to fourth LED portions compose the LED unit 10. In addition, the LED unit 10, an LED driving portion 3, and the current detection portion 4 are serially connected to each other through the output line OL.

The first bypass portion 21 is connected to one end of the second LED portion 12. The second bypass portion 22 is connected to one end of the third LED portion 13. The third bypass portion 23 is connected to one end of the fourth LED portion 14. Thus, the bypass portions can restrict the flowing current amount in the LED portions. The first, second and third bypass portions 21, 22 and 23 are connected in parallel to the LED portions. One end of each bypass portion is connected to the one end of corresponding one of the LED portions. Another end of each bypass portion is connected to the upper stream side of the current detection portion 4. Thus, the bypasses can adjust the flowing current amount in the LED portions. In other words, each of the first, second and third bypass portions 21, 22 and 23 can adjust the amount of a bypassed current, which in turn can control the flowing current amount in the LED portions. In the case of FIG. 1A, the first bypass portion 21 is connected in parallel to the second LED portion 12, and forms a first bypass BP1. Also, the second bypass portion 22 is connected in parallel to the third LED portion 13, and forms a second bypass BP2. Also, the third bypass portion 23 is connected in parallel to the fourth LED portion 14, and forms a third bypass BP3. This parallel connection of the bypass portion does not necessarily require that the bypass portion is connected to the both ends of each of the LED portions, but only require that one end of the bypass portion is connected to one end of the LED portion so that a current can branch. For example, in the case of FIG. 1A, one end of the first bypass portion is connected to the upper-stream-side end of the second LED, while another end of the first bypass portion is connected the upper-stream-side end of the current detection portion on the output line OL. In other words, the parallel connection of the bypass portion refers to a connection that allows a current to branch after flowing through the LED portion, which is connected on the output line OL.

(Current Control Circuit)

In addition, a current control circuit is provided which controls a current circuit for applying a current to the LED portions. In the case of the circuit shown in FIG. 1A, a type of constant current circuit is constructed of the first, second, third and fourth bypass portions 21, 22, 23 and 24, the current control portion 30, and the current control signal generation portion 5. The current circuit is controlled by the current control portion 30 and the current control signal generation portion 5.

(Current Control Portion 30)

The current control portion 30 is connected through the current control signal generation portion 5 to the first, second, third and fourth bypass portions 21, 22, 23 and 24. The current control portion controls operation of the first, second, third and fourth bypass portions such as ON/OFF and continuously variable current amount control of the first, second, third and fourth bypass portions. The current control portion 30 is connected to the current detection portion 4, and monitors the amount of current in the LED unit 10. The current control portion can adjust control values of the first, second, third and fourth bypass portions 21, 22, 23 and 24.

(First to Fourth LED Portions 11 to 14)

Each LED portion includes one LED device or a plurality of LED devices, which are connected to each other in series and/or in parallel. Surface-mount type LEDs (SMDs) or bullet type LEDs can be suitably used for the LED devices. SMD type LED devices can have packages with various external shapes, such as a rectangular shape in plan view, depending on applications. Needless to say, a plurality of LED devices can be connected to each other in series and/or in parallel inside an LED package as the LED portion.

Generally, a subtotal forward directional voltage of an LED portion is defined by the sum of the forward directional voltages of LED devices, which are included in the LED portion. More specifically, a subtotal forward directional voltage is determined by the number of the LED devices that are connected to each other in series in the LED portion. For example, in the case where six LED devices are employed which have a forward directional voltage of 3.6 V, the subtotal forward directional voltage of the six LED devices will be $3.6\times6=21.6$ V.

The light-emitting diode driving apparatus 100 can control the flowing current amount in the LED portions based on a current value that is detected by the current detecting portion 4. In other words, a current is controlled not based on the voltage value of rectified voltage but based on the amount of an actually-flowing current. For this reason, the LED portions can be accurately switched at proper timing irrespective of deviation of the forward directional voltages of LED devices. Therefore, reliable and stable operation can be expected. The current value can be detected by the current detection portion 4, or the like. A resistor or the like can be suitably used as the current detection portion 4.

In the case of FIG. 1A, the current control portion 30 controls the restriction amount on a flowing current in the first LED portion 11 that is restricted by the first bypass portion 21 based on the flowing current amount in the first LED portion 11. Specifically, in the case where the first, second, third and fourth bypass portions 21, 22, 23 and 24 are in the ON state, the first bypass portion 21 can apply a certain amount of current to the first LED portion 11 in accordance with the flowing current amount. Subsequently, the input voltage will rise. When the input voltage reaches a voltage, which can drive both the first and second LED portions 11 and 12, a current starts flowing into the second LED portion 12. After that, when the current exceeds a predetermined value, the first bypass portion 21 is turned OFF. Also, the current control portion 30 controls the flowing current restriction for the first and second LED portions 11 and 12 through the second bypass portion 22 based on the flowing current amount in the first and second LED portions 11 and 12. Specifically, the second bypass portion 22 applies a certain amount of current to the first and second LED portions 11 and 12 in accordance with the flowing current amount in the first and second LED portions. Subsequently, the input voltage will rise. When the input voltage reaches a voltage that can drive the first, second and third LED portions 11, 12 and 13 together, a current starts flowing into the third LED portion 13. After that, when a current exceeds another predetermined value, the second bypass portion 22 is turned OFF.

Also, the current control portion 30 controls the flowing current restriction for the first, second and third LED portions 11, 12 and 13 through the third bypass portion 23 based on the flowing current amount in the first, second and third LED portions 11, 12 and 13. Specifically, the third bypass portion 23 applies a certain amount of current to the first, second and third LED portions 11, 12 and 13 in accordance with the flowing current amount in the first, second and third LED portions. Subsequently, the input voltage will rise. When the input voltage reaches a voltage that can drive the first, second, third and fourth LED portions 11, 12, 13 and 14 together, a current starts flowing into the fourth LED portion 14. Subsequently, when a current exceeds another predetermined value, the third bypass portion 23 is turned OFF. Finally, the fourth bypass portion 24 and the current control portion 30 apply a certain amount of current to the first, second, third and fourth LED portions 11, 12, 13 and 14 in accordance with the flowing current amount in the first, second, third and fourth LED portions.

The light-emitting diode driving apparatus 100 using AC power AP such as commercial power for home use includes a plurality of bypass portions that drive a suitable number of serially-connected LED devices in accordance with a periodically-varying pulsating voltage that is obtained after an alternating current is subjected to full-wave rectification. Thus, the bypass portions can be properly driven by the current control portion.

In the light-emitting diode driving apparatus 100, as the current value rises, a current starts flowing into the first LED portion 11, the second LED portion 12, the third LED portion 13, and the fourth LED portion 14 in this order. In particular, the flowing current amount in the LED portions is restricted based on the current value so that the flowing current amount in the LED portions can be controlled in accordance with the current value. Therefore, the LEDs can be efficiently driven by a pulsating voltage.

In the case of FIG. 1A, the LED driving portion 3 is connected in parallel to the fourth bypass portion 24 so that a current, which will flow in the fourth bypass portion 24, can partially flow into the LED driving portion 3. Thus, the LED driving portion 3 can reduce the load of the fourth bypass portion 24.

(Harmonic Suppression Signal Generation Portion 6)

The current control portion 30 is connected to a harmonic suppression signal generation portion 6. The harmonic suppression signal generation portion 6 provides a harmonic suppression signal voltage in accordance with a rectified voltage, which is provided from the rectifying circuit 2. The harmonic suppression signal generation portion 6 reduces a rectified voltage, which is rectified by the rectifying circuit 2, at a certain ratio, and provides the reduced voltage to the current control portion 30. The current control portion 30 receives the signal, which is provided from the harmonic suppression signal generation portion 6, as a reference signal, and compares this reference signal with a current detection signal that is detected by the current detection portion 4. The current control portion 30 drives the LED portions at proper timing and applies a proper amount of current to the LED portions based on the comparison result by using the first to fourth bypass portions 21 to 24.

(Smoothing Circuit)

The light-emitting diode driving apparatus shown in FIG. 1A additionally includes a smoothing circuit that is connected in parallel to the LED unit 10. The smoothing circuit serves to reduce light OFF periods of the LED unit 10. The smoothing circuit includes a first charging/discharging capacitor 111, for example.

(Operation for Charging First Charging/Discharging Capacitor 111)

The voltage between the terminals of the first charging/discharging capacitor 111 will be the sum $V_{fall}$ of the forward voltages of all the LEDs of the first to fourth LED portions 11 to 14 in the case where all the first to fourth LED portions are driven. Accordingly, when the input voltage reaches a voltage value that can drive the first to fourth LED portions 11 to 14, the capacitor charging operation starts. After that, when the input voltage decreases to a voltage value that cannot apply a certain amount of current that is specified by the current control portion 30 to the first to fourth LED portions 11 to 14 (in other words, when the driving phase shifts to the state where the first to third LED portions 11 to 13 are driven), the capacitor charging operation stops. In the charging operation, as the capacitor terminal voltage rises, $V_{fall}$ will rise. Correspondingly, the LED driving current increases, while the charging current for charging the first charging/discharging capacitor 111 gradually decreases. The current control portion 30 adjusts a superposed current of the capacitor charging current and the LED driving current to a sine wave current. Thus, the first charging/discharging capacitor 111 can be charged without affecting the entire current of the light-emitting diode driving apparatus, which is controlled by a current waveform approximating to the original sine wave.

(Operation for Discharging First Charging/Discharging Capacitor 111)

The first charging/discharging capacitor 111 discharges the charged electric charge to the first to fourth LED portions 11 to 14, which are connected to the first charging/discharging capacitor. Since the charged voltage of the first charging/discharging capacitor 111 will be the sum $V_{f1\text{-}4}$ of the serially-connected first to fourth LED portions 11 to 14, which compose the LED unit 10, the first charging/discharging capacitor 111 will not be discharged at a current larger than a current that flows in the LED unit 10 when the capacitor is charged.

Figure 1B:
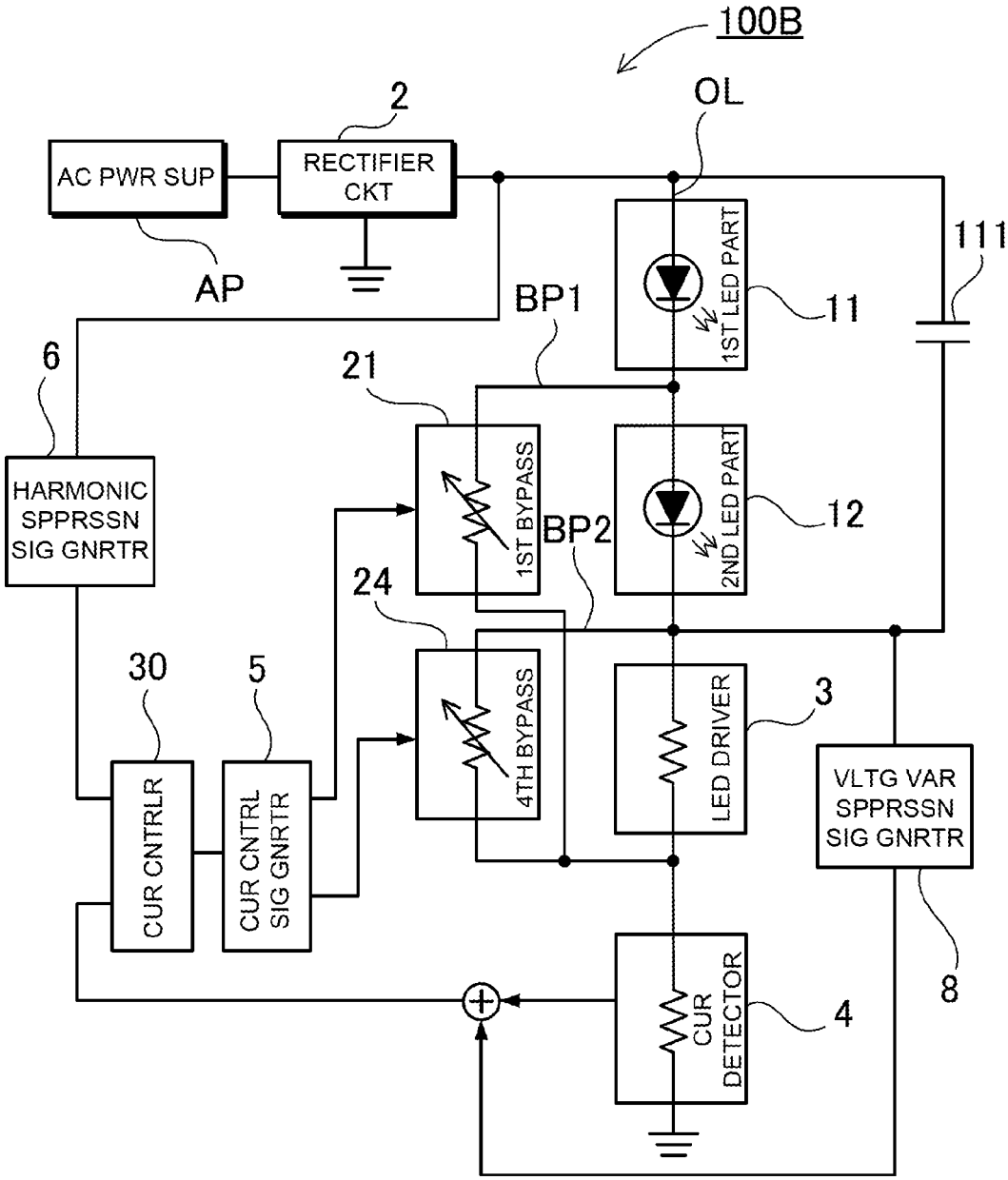
FIG. 1B is a block diagram showing a light-emitting diode driving apparatus according to a modified embodiment.

In this embodiment, it has been described that the light-emitting diode driving apparatus includes four LED portions as the first to fourth LED portions 11 to 14. However, the present invention is not limited to this construction. The number of the LED portions can be a plural number. For example, the number of the LED portions can be not greater than three, or not smaller than five. For example, a light-emitting diode driving apparatus 100B according to a modified embodiment shown in FIG. 1B includes two LED portions as the first and second LED portions 11 and 12, and the first bypass portion 21 and the fourth bypass portion 24, which control light emission of the two LED portions. The number of the LED portions can be suitably selected depending on required light amount, quality such as crest factor, power consumption, cost, and the like.

(Exemplary Circuit According to First Embodiment)

Figure 2:
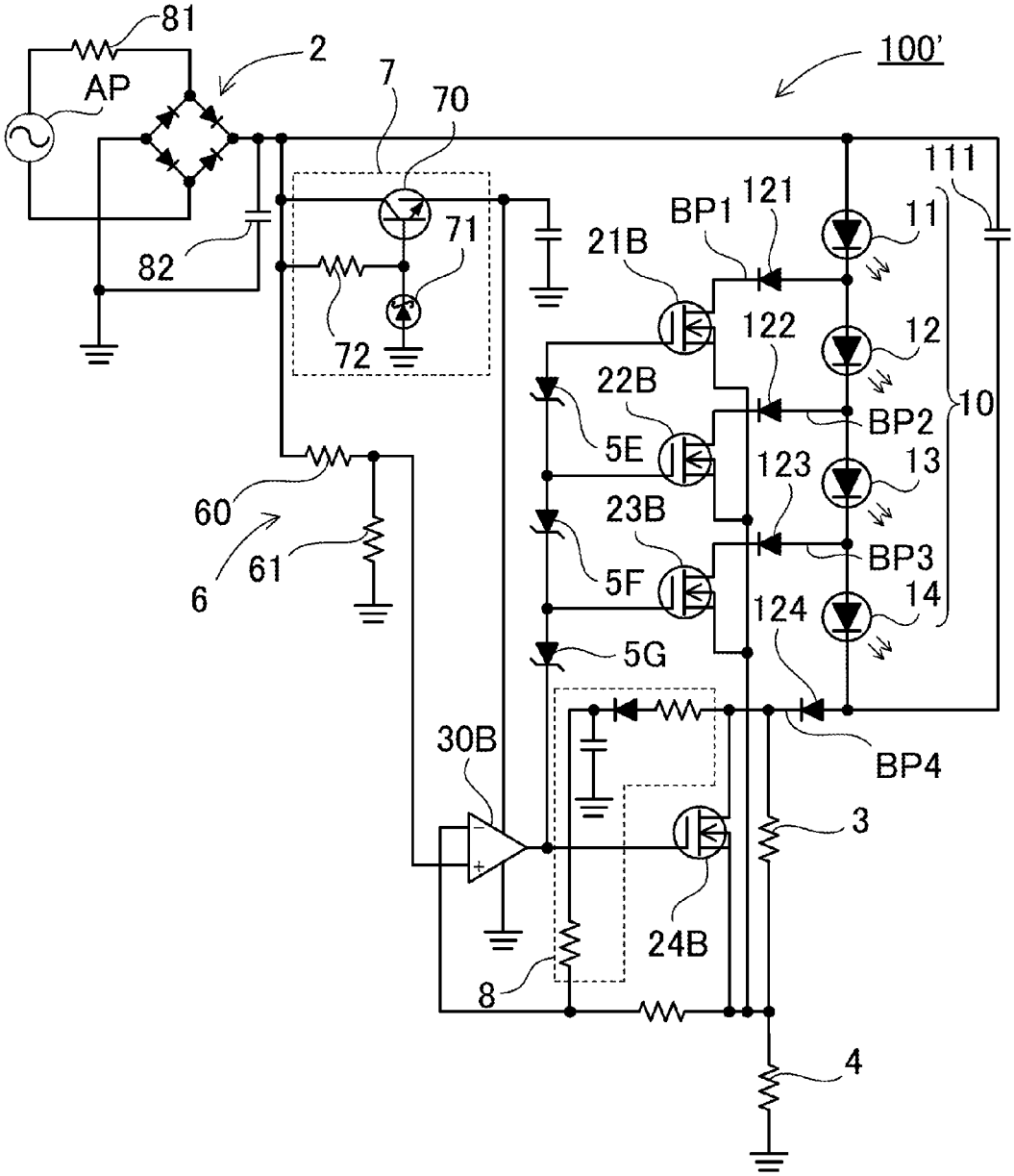
FIG. 2 is a circuit diagram showing an exemplary circuit of the light-emitting diode driving apparatus shown in FIG. 1A.

FIG. 2 shows an exemplary circuit that corresponds to the light-emitting diode driving apparatus 100 shown in FIG. 1A, and includes semiconductor devices. In a light-emitting diode driving apparatus 100', a diode bridge is used as the rectifying circuit 2, which is connected to the AC power supply AP. A protection resistor 81 is connected between the AC power supply AP and the rectifying circuit 2. A bypass capacitor 82 is connected to the output side of the rectifying circuit 2. In addition, although not illustrated, a fuse and a surge protection circuit for preventing an over-current flow can be connected between the AC power supply AP and the rectifying circuit 2.

(AC Power Supply AP)

The 100-V or 200-V commercial power can be suitably used as the AC power supply AP. The voltage 100 or 200 V in this commercial power is an effective value. The maximum voltage of a rectified waveform subjected to full-wave rectification will be about 141 or 282 V.

(LED Unit 10)

A plurality of LEDs are assigned to a plurality of LED blocks as LED portions, which compose the LED unit 10. The LED blocks are connected to each other in series. Terminals are provided between the blocks, and are connected to the first, second, third and fourth bypass portions 21, 22, 23 and 24. The LED unit 10 is constructed of four groups as the first, second, third and fourth LED portions 11, 12, 13 and 14 in the case of FIG. 2.

In FIG. 2, each of the LED portions 11 to 14 is shown by a single LED symbol, which represents an LED package 1 including a plurality of LED chips. In this embodiment, each LED package 1 includes ten LED chips. The number of light emitting diodes to be connected to each other in each LED portion or the number of the LED portions to be connected to each other can be determined depending on the sum of forward directional voltages (i.e., the number of the LED devices connected to each other in series) and the voltage of power supply to be used. For example, in the case where the commercial power is used, a total forward directional voltage $V_{fall}$ as the sum of $V_f$ values of the LEDs of the LED portions is adjusted to about 141 V or not more than 141 V.

Each LED portion can include an arbitrary number of LED devices (at least one LED device). The LED device can be a single LED chip, or a single package including a plurality of collectively-arranged LED chips. In this embodiment, each of the illustrated LED symbols is the LED package 1, which includes ten LED chips.

The four LED portions have the same $V_f$ value in the case of FIG. 2. However, the number of LED portions is not limited to this. The number of LED portions can be three or less, or five or more as stated above. In the case where the number of LED portions is increased, the number of current control stages is increased. In this case, the LED portion switching transition can be smoother. Alternatively, the $V_f$ values of LED portions may not be the same.

(First To Fourth Bypass Portions 21 to 24)

The first, second, third and fourth bypass portions 21, 22, 23 and 24 correspond to the LED portions, and apply a current to the LED portions. The first to fourth bypass portions 21 to 24 are constructed of switching devices such as transistors. In particular, FETs are preferable. The reason is that saturation voltage between source and drain of FET is substantially zero, and will not reduce a flowing current amount in the LED portion. However, needless to say, the first to fourth bypass portions 21 to 24 are not limited to FETs but can be constructed of bipolar transistors or the like.

In the case of FIG. 2, LED current control transistors are used as the first to fourth bypass portions 21 to 24. Specifically, the second LED portion 12 is connected to a first LED current control transistor 21B. Also, the third LED portion 13 is connected to a second LED current control transistor 22B. Also, the fourth LED portion 14 is connected to a third LED current control transistor 23B. Also, the LED driving portion 3 is connected to a fourth LED current control transistor 24B. The first to fourth LED current control transistors 21B to 24B serve as the first to fourth bypass portions 21 to 24, respectively. Each of the LED current control transistors is switched between ON/(current control)/OFF in accordance with the current amount in the LED portions. When the LED current control transistor is turned OFF, a current will not flow in the bypass so that the current starts flowing the corresponding LED portion. In other words, each of the first to fourth bypass portions 21 to 24 can adjust the amount of a bypassed current, which in turn can control the flowing current amount in the LED portions. In the case of FIG. 2, the first bypass portion 21 is connected in parallel to the second LED portion 12, and forms the first bypass BP1. Also, the second bypass portion 22 is connected in parallel to the third LED portion 13, and forms the second bypass BP2. Also, the third bypass portion 23 is connected in parallel to the fourth LED portion 14, and forms the third bypass BP3. Also, the fourth LED current control transistor 24B is connected in parallel to the LED driving portion 3, and forms a fourth bypass BP4. The fourth LED current control transistor can control the flowing current amount in the first, second, third and fourth LED portions 11, 12, 13 and 14.

(Backflow-Preventing Diode)

Backflow-preventing diodes are provided on the bypasses. Specifically, the first, second, third and fourth backflow-preventing diodes 121, 122, 123 and 124 are provided on the first, second, third and fourth bypasses BP1, BP2, BP3 and BP4, respectively.

The first LED portion 11 is not connected in parallel to the bypass or the bypass portion. The reason is that the flowing current amount in the first LED portion 11 can be controlled by the first bypass portion 21, which is connected in parallel to the second LED portion 12. Also, the flowing current amount in the fourth LED portion 14 can be controlled by the fourth LED current control transistor 24B.

(LED Driving Portion 3)

In the case of FIG. 2, a resistor is used as the LED driving portion 3. In this embodiment, the LED driving portion 3 is connected in parallel to the fourth LED current control transistor 24B as the fourth bypass portion. Accordingly, if the amount of current becomes high, the current that will flow in the fourth bypass portion can branch to the LED driving portion 3. As a result, the load of the fourth bypass portion can be reduced. However, in the case where the fourth bypass portion is sufficiently resistant to electric current, the LED driving portion can be omitted.

(Current Control Portion 30B)

The current control portion serves to allow the first to fourth bypass portions 21 to 24 to apply a current to the corresponding LED portions at proper timing. The current control portion uses the rectified voltage, which is rectified by the rectifying circuit 2, as a reference voltage to provide operation control signals for controlling operation of the bypass portions. Accordingly, the amount of current on the output line OL that is detected by the current detection portion 4 can be adjusted to a value that is proportional to the rectified voltage. As a result, the input current of the entire circuit can be a waveform that is proportional to the AC input voltage. Therefore, it is possible to suppress harmonic components.

A switching device such as transistor can be used also as the current control portion 30B shown in FIG. 2. In particular, a bipolar transistor can be suitably employed to detect a current amount. In this embodiment, an operational amplifier 30B is used as the current control portion 30B. However, needless to say, the current control portion is not limited to an operational amplifier, but can include an comparator, bipolar transistor, MOSFET, or the like.

In the case of FIG. 2, the current control portion 30B controls operation of the LED current control transistors 21B to 24B. In other words, the operational amplifier controls the flowing current so that the LED current control transistors is switched between OFF/(current control)/ON.

(Current Detection Portion 4)

The current detection portion 4 serves to detect the current that flows in the LED unit 10, which includes serially-connected LED portions, based on the voltage drop or the like. A current is applied to the LED portions, which compose the LED unit 10, in accordance with the current detection by the current detection portion 4. The current detection portion 4 also serves as a protection resistor for protecting the LEDs. In order to apply a current to the LED portions based on the current detection signal that is detected by the current detection portion 4, the current detection portion 4 is connected to the operational amplifier 30B as the current control portion 30B for controlling the current circuit. In this exemplary circuit, a type of constant current circuit can be constructed of the first, second, third and fourth bypass portions 21, 22, 23 and 24, and the current control portion 30B.

(Current Control Signal Generation Portion 5)

The current control signal generation portion 5 is provided between the current control portion 30B and the bypass portions. According to this construction, in order that a voltage difference can be produced between the operation control signals that are applied to the first and fourth bypass portions 21 and 24, the current control signal generation portion 5 is provided. As a result, operation of the first and fourth bypass portions 21 and 24 can be reliably switched. The current control signal generation portion 5 specifies the ON/OFF timing of the LED current control transistors. In this embodiment, the current control signal generation Zener diodes 5E, 5F and 5G are specified and provided as the current control signal generation portion 5 so that the first to fourth LED current control transistors 21B to 24B are turned OFF one by one in this order as the input voltage rises. Although the current control signal generation portion 5 is constructed of Zener diodes in the case of FIG. 2, the current control signal generation portion 5 can be constructed of resistors, diodes, and the like.

In the exemplary circuit of FIG. 2, the first, second, third and fourth LED portions 11, 12, 13 and 14 are turned ON in this order (and the flowing current amounts of the LED portions are controlled) as the input voltage rises. On the other hand, as the input voltage decreases, the LED portions are turned OFF in the inverse order.

(Harmonic Suppression Signal Providing Resistors 60 and 61)

In the exemplary circuit of FIG. 2, the current control portion 30B is constructed of the operational amplifier 30B. The operational amplifier 30B is controlled by the harmonic suppression signal generation portion 6. The harmonic suppression signal generation portion 6 includes harmonic suppression signal generation resistors 60 and 61. The harmonic suppression signal generation resistors 60 and 61 divide the rectified voltage, which is rectified by the rectifying circuit 2. In other words, the harmonic suppression signal providing portion 6 provides a desired fraction of the rectified voltage. The positive-side input terminal of the operational amplifier as the current control portion is provided with a harmonic suppression signal, which is a fraction voltage of sine wave provided by the harmonic suppression signal generation resistors 60 and 61.

(Constant-Voltage Power Supply 7)

The operational amplifier 30B is driven by a constant-voltage power supply 7. The constant-voltage power supply 7 includes a transistor 70 as operational amplifier power supply, a Zener diode 71, and a Zener voltage setting resistor 72. The constant-voltage power supply 7 supplies power to the operational amplifier 30B only during the period which the Zener voltage of the Zener diode 71 is lower than the rectified voltage after the rectifying circuit 2 rectifies the current from the AC power supply AP. This period is previously specified so as to include the light emission period of the LED unit 10. That is, the operational amplifier 30B is activated during the light emission of the LED unit 10, and controls the light emission of the LED unit 10.

On the other hand, the negative-side input terminal of the operational amplifier 30B is provided with a voltage as the current detection signal, which is detected by the current detection resistor 4. The voltage of the current detection resistor 4 is controlled whereby controlling a current in accordance with the sine wave that is applied to the positive-side input terminal of the operational amplifier 30B. Since the current is controlled in accordance with the sine wave, the LED driving current can have a shape approximating a sine wave.

Each LED portion can be constructed of a plurality of light emitting diode devices that are connected to each other in series. Accordingly, a rectified voltage can be effectively divided by the light emitting diode devices.

In addition, the light emitting diode devices can smooth out a certain deviation of forward directional voltages $V_f$ and the temperature characteristics of light emitting diode devices. The number of LED portions, the number of light emitting diode devices composing each LED portion and the like can be suitably adjusted depending on required brightness, supplied voltage and the like. For example, an LED portion can consist of one light emitting diode device. The number of LED portions can be increased so that the LED portions switching transition is smoother. Conversely, the number of LED portions can be two for simple control.

Although it has been described that the number of LED portions is four in the aforementioned configuration, needless to say, the number of LED portions can also be two or three, or five or more. In particular, in the case where the number of LED portions is increased, the sinusoidal current waveform can be formed at lower voltage of power supply. Accordingly, it is possible to further suppress harmonic components. Although the LED portions are turned ON/OFF one by one every when the input current reaches predetermined values the differences of which are substantially constant in the case of FIG. 2, the differences of the predetermined values are not limited to constant. The LED portions may be turned ON/OFF one by one every when the input current reaches predetermined values the differences of which are not constant.

Although the LEDs are distributed in the four LED portions each of which has the same $V_f$ value in the foregoing embodiment, the LED portions are not required to have the same $V_f$ value. For example, if the $V_f$ value of the first LED portion is reduced as lower as possible, in other words, if the $V_f$ value of the first LED portion is set about 3.6 V, which corresponds to the $V_f$ value of a single LED, the leading edge of the current can be closer to the rise timing of the sine wave from zero while the trailing edge of the current can be closer to the decay timing of the sine wave to zero. In this case, it is more advantageous to reduce harmonic components. In the case where the number and the $V_f$ values of the LED portions are suitably selected, the current waveform can more closely approximate a sine wave. Such flexibility can more easily provide harmonic suppression.

(Voltage Variation Suppression Signal Generation Portion 8)

In the light emitting diode drive apparatus according to the present invention, a voltage variation suppression signal generation portion 8 can be additionally provided which generates a voltage variation suppression signal, and provides the voltage variation suppression signal to the current control portion. The voltage variation suppression signal generation portion 8 is connected in series to the charging/discharging capacitor 111, and detects rectified voltage variation.

The current control portion 30 controls operation of the bypass portions based on the sum of the rectified voltage variation, which is detected by the voltage variation suppression signal generation portion 8, and the current detection signal, which is detected by the current detection portion 4. Accordingly, the amount of current on the output line OL that is detected by the current detection portion 4 is proportional to the rectified voltage. Accordingly, if the average value of the rectified voltage varies, the current amount average value of the output line OL will vary in proportion to the average value of the rectified voltage. To address this, the rectified voltage suppression signal is added to the current detection signal so that, even if the average value of the rectified voltage varies, the variation of the current amount average value of on the output line OL can be suppressed. As a result, it is possible to provide stable light output.

In the exemplary circuit of FIG. 2, the voltage variation suppression signal generation portion 8 is shown by the area enclosed by the dashed line. The voltage variation suppression signal generation portion 8 integrates the voltage variation suppression signal, and then adds the integrated signal to the current detection signal. According to this construction, if the rectified voltage varies, it is possible to suppress the variation of the average current.

(Operation for Charging First Charging/Discharging Capacitor 111)

Figure 18:
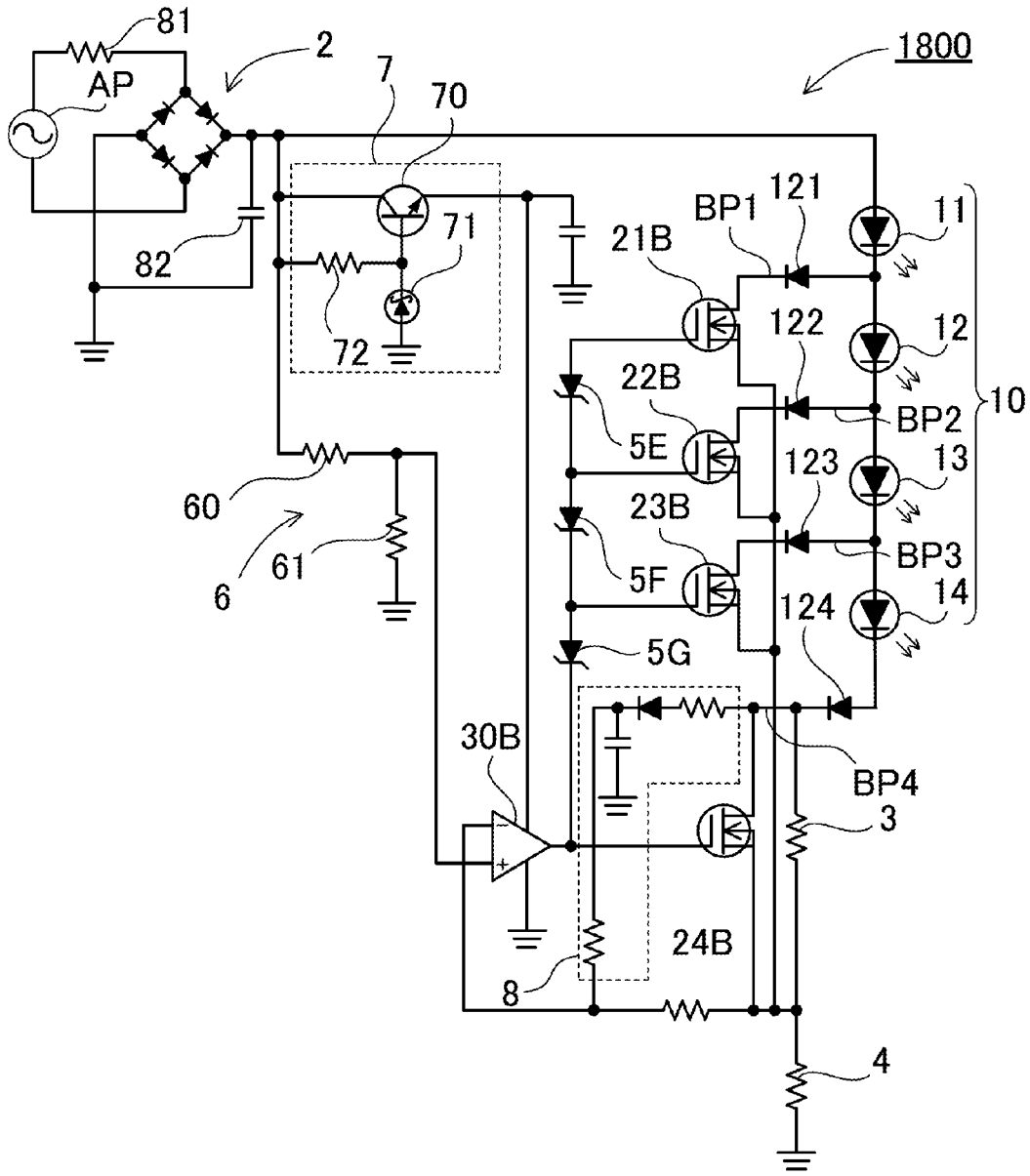
FIG. 18 is a circuit diagram showing a light-emitting diode driving apparatus according to a modified embodiment.
Figure 19:
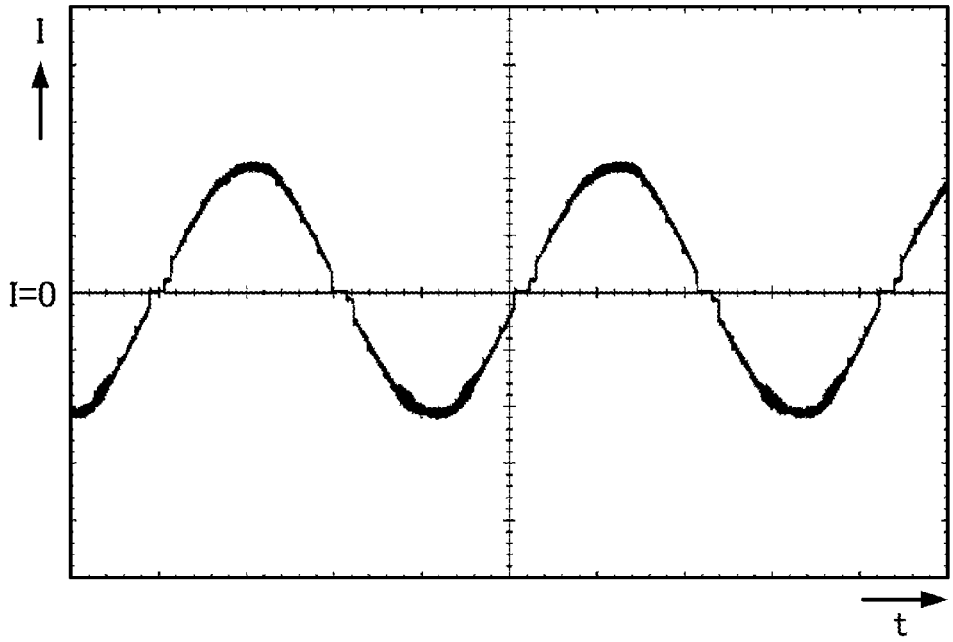
FIG. 19 is a graph showing the input current waveform of the light-emitting diode driving apparatus shown in FIG. 18.

The current waveform of the light-emitting diode driving apparatus 100' shown in FIG. 2 is the same as the current waveform shown in FIG. 19. FIG. 19 shows a current waveform of a light-emitting diode driving apparatus 1800 (shown in a circuit diagram of FIG. 18) according to a modified embodiment of the light-emitting diode driving apparatus 100' shown in FIG. 2, which does not includes the first charging/discharging capacitor 111. Members in FIG. 18 are the same as the members in FIG. 2 except that the first charging/discharging capacitor 111 is omitted. Their description is omitted for the sake of brevity.

The first charging/discharging capacitor 111 in the light-emitting diode driving apparatus 100' shown in FIG. 2 is charged through the power supply line, the first charging/discharging capacitor 111, the fourth backflow-preventing diode 124, and the fourth LED current control transistor 24B. This charging operation is performed when the light emission of the LED unit 10 is controlled by the fourth LED current control transistor 24B. As discussed above, the first charging/discharging capacitor is charged with a charging current so that the capacitor terminal voltage will be equal to the total $V_f$ value of the LED unit 10. On the other hand, this charging current is superposed on the LED current, which flows in the LED unit 10. The fourth current control transistor 24B controls the superposed current so that the superposed current approximates a sine wave. Thus, the first charging/discharging capacitor 111 can be charged without affecting the harmonic distortion suppression function that is provided by the exemplary circuit 1800 of FIG. 18.

The amount of LED current is reduced by the amount of capacitor charging current in the period where the capacitor is charged. In the exemplary circuit of FIG. 2, the fourth LED current control transistor 24B adjusts a current to a sine wave current in the period where all of the LED portions (i.e., the first to fourth LED portions 11 to 14) are brought ON, in other words, in the period where the power supply voltage is near its peak voltage. In this period, the light output is also brought to its peak output. If the LED current can be reduced in this period, the peak light output can be suppressed. As a result, it is possible to reduce the light output ripple factor. To achieve this, the first charging/discharging capacitor 111 is charged in this period so that the peak light output is suppressed. The electric power is stored in the capacitor, and is then discharged when the power supply voltage is low so that light output is obtained. In this case, it is possible to provide both the light output ripple factor improvement effects.

(Ripple Factor Improvement)

Figure 17:
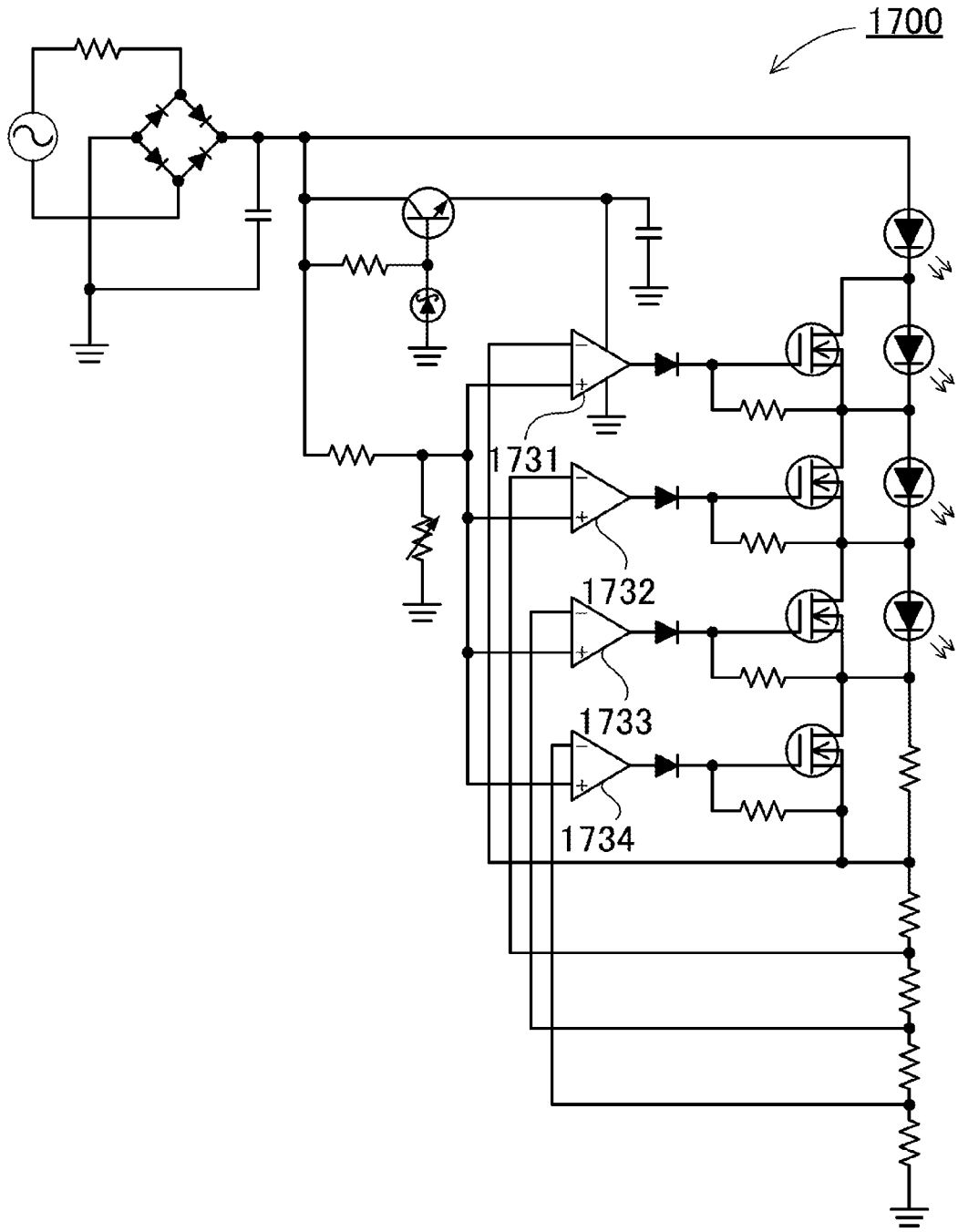
FIG. 17 is a circuit diagram showing a light-emitting diode driving apparatus that has been developed by the applicant.
Figure 20:
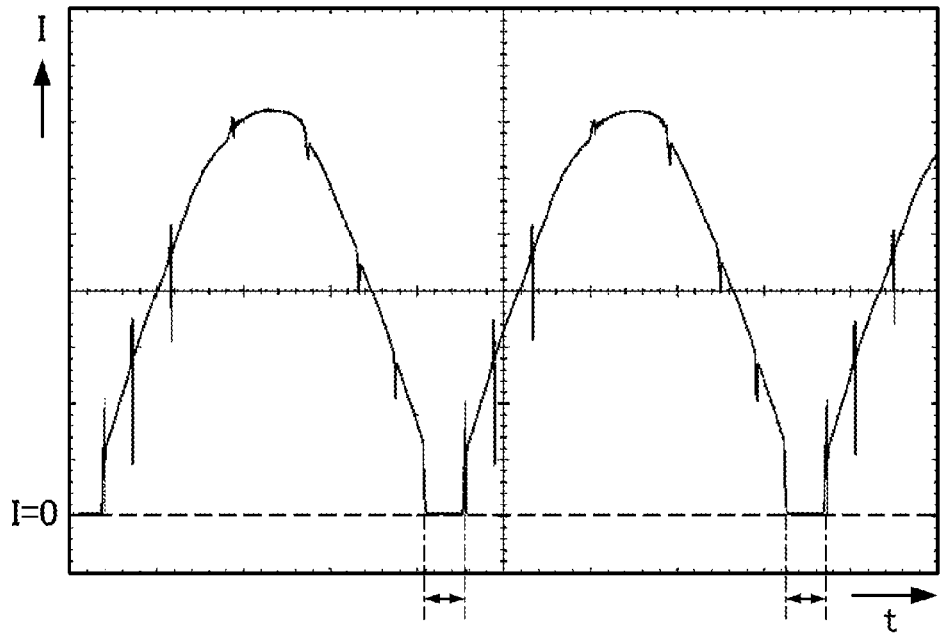
FIG. 20 is a graph showing the current waveform of a first LED portion of the light-emitting diode driving apparatus shown in FIG. 18.
Figure 21:
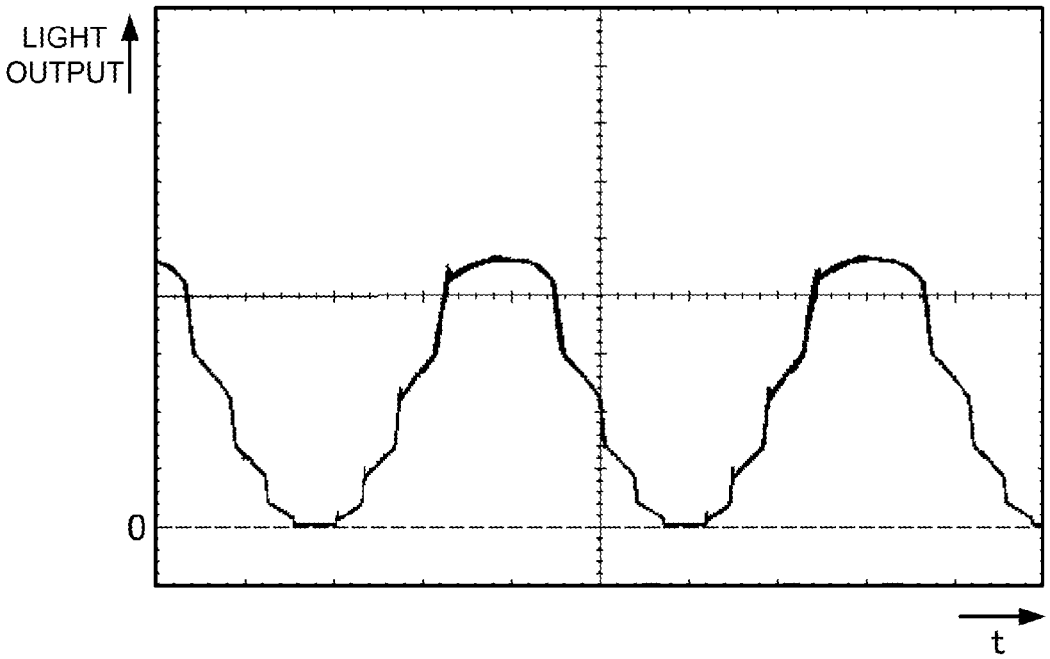
FIG. 21 is a graph showing the light output waveform of the light-emitting diode driving apparatus shown in FIG. 18.

In terms of output light quality improvement, it is important for the light-emitting diode driving apparatus to reduce light OFF periods to improve the ripple factor without disturbing the input current waveform that approximates a sine wave. With reference to FIGS. 17 to 21, ripple factor improvement is now described. The applicant has been developed a light-emitting diode driving apparatus 1700 that includes a plurality of LEDs that are connected to each other (in multi stages), and can suppress harmonic components, as shown in FIG. 17. In this circuit, the first, second, third and fourth current control portions 1731, 1732, 1733 and 1734 are constructed of operational amplifiers. In addition, the applicant has been improved this apparatus and also developed the light-emitting diode driving apparatus 1800 shown in FIG. 18. FIG. 19 shows a graph of a power supply input current waveform that is obtained by the light-emitting diode driving apparatus 1800. FIG. 20 shows a current waveform in the first LED block 11. As shown in the graph of FIG. 19, harmonic distortion of power supply input current can be suppressed so that the LEDs can be driven by a current with a current waveform close to a sine wave. On the other hand, in the case where conventional filament lamps are used as light emitting devices instead of LEDs, a current flowing in the filament lamps will also have a substantially sine waveform. In the case of filament lams, since light is produced as incandescence from filament, the light does not fluctuate at power supply frequency (50 or 60 Hz), in other words, filament lamps are not cyclically turned ON/OFF at the period of power supply frequency. Contrary to this, in the case where LEDs are used as light emitting devices, since LEDs have high responsivity, there is a problem that flicker will occur at the power supply frequency. This can be seen from a light output waveform of a sine wave multi-stage driving circuit shown in FIG. 21. The ripple factor (=(maximum value−minimum value)/average value) is used as objective index, and gets better as it gets closer to 0 (zero). The calculated ripple factor of this light output shown in FIG. 21 is not smaller than 2.0. This value is worse than filament lamp of 0.1 or smaller, fluorescent lamp of about 0.9, and inverted fluorescent lamp of about 0.2. This means that some people may perceive flicker. Accordingly, these may cause poor lighting quality. For this reason, if the light-emitting diode driving apparatus shown in FIG. 18 is used for high quality lighting, it is necessary to eliminate the light OFF period and to improve its ripple factor. It can be conceived that a capacitor is used for smoothing to eliminate the light OFF period. That is, it can be conceived that the capacitor is charged in the period where a power supply voltage is high, and is discharged in the period where the voltage is low. However, if a capacitor is used, the capacitor will be rapidly charged in a short charging period, which in turn increases the charging current. In addition, the charging current will be increased with the capacity of the capacitor. In the case of a large capacitor to be used for such smoothing, the charging current will be further increased, which in turn deteriorates the power factor. For this reason, such a light-emitting diode driving apparatus may not meet the harmonic distortion standards. On the other hand, it can be conceived that an active filter IC is additionally used to improve the power factor. However, there are disadvantages that such a device is expensive, and that high frequency switching noise may be produced. To address the disadvantages, in the foregoing first embodiment, as discussed above, the charging/discharging capacitor 111 is used to be charged when the rectified voltage applied to the LED unit 10 becomes high so that the charged electric charge can be discharged to apply a current to the LED unit 10 when the rectified voltage becomes low. As a result, it is possible to reduce the difference of the current amounts in the LED unit 10. Consequently, the ripple factor can be successfully improved. In addition, since the LED driving portion 3, and the first to fourth bypass portions 21 to 24 are provided on the charging path, an inrush current into the charging/discharging capacitor 111 can be suppressed. Therefore, it is possible to prevent power factor reduction.

(Operation for Discharging First Charging/Discharging Capacitor 111)

The operation for discharging the first charging/discharging capacitor 111 is now described. In the light-emitting diode driving apparatus 100' shown in FIG. 2, the discharging circuit for discharging the first charging/discharging capacitor 111 is constructed of the LED unit 10 of the first to fourth LED portions 11 to 14. Thus, although all of the LED portions are to be supplied with the discharging current, the discharging current does not flow in the sine wave multi-stage drive circuit. Accordingly, the discharging current does not affect the operation of the sine wave multi-stage drive circuit.

Figure 3:
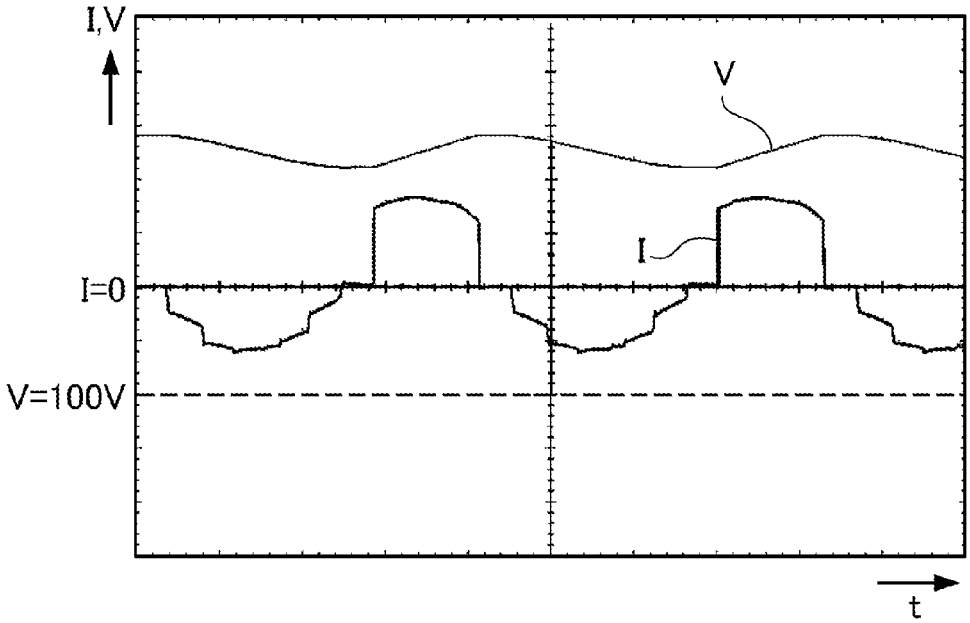
FIG. 3 is a graph showing the charging/discharging current and the voltage waveform of a capacitor in the light-emitting diode driving apparatus according to the first embodiment.

FIG. 3 is a graph showing waveforms of capacitor charging/discharging current and voltage for discharging the first charging/discharging capacitor 111. In this graph, the capacitor charging/discharging current waveform and the capacitor charging/discharging voltage waveform are shown by I and V, respectively. When the capacitor is charged, the terminal voltage of the capacitor will be increased to a voltage substantially equal to an LED terminal voltage $V_{fa}$, which corresponds to an LED current when all of the LED portions are brought ON, in other words, corresponds to a current $I_{fa}$, which is obtained by subtracting a capacitor charging current from a control current that is controlled (adjusted) by the fourth LED current control transistor 24B. For this reason, although a discharging current from the first charging/discharging capacitor is not adjusted, the discharging current will be limited by the LED terminal voltage $V_{fa}$. As a result, a discharging current larger than $I_{fa}$ will not flow.

When operation for charging the capacitor stops, the charging current stops flowing. Accordingly, immediately after the operation for charging the capacitor stops, the LED driving current increases so that the terminal voltages of the LEDs correspondingly rise. As a result, the capacitor will not be discharged immediately after operation for charging the capacitor stops. After that, the power supply voltage further decreases so that the number of driven groups becomes two, which are the first and second LED portions 11 and 12 in the sine wave multi-stage driving circuit, (the third and fourth LED portions 13 and 14 are brought OFF in the sine wave multi-stage driving). In this control transition, the capacitor terminal voltage will exceed the LED terminal voltage so that operation for discharging the capacitor will start. This discharging current is superposed on the sine wave driving current in FIG. 20. The superposed current flows in LEDs. Accordingly, the LED terminal voltages rise so that the discharging current is reduced. Therefore, an excess amount of current will not flow into the LEDs. As the power supply voltage decreases, the number of LED portions is reduced which are driven by the sine wave multi-stage driving circuit. Correspondingly, the LED terminal voltage variation in accordance with the drive current will decrease.

Thus, the LED terminal voltage is increased/reduced in accordance with the increase/reduction of driving current. That is, the terminal voltage of the LED portion will be higher when the LED portion is driven by the multi-stage driving circuit than when the LED portion is not driven. For this reason, the LED terminal voltage will be higher as the number of LED portions is increased which are driven by the multi-stage driving circuit. As a result, in the period where the LED terminal voltage exceeds the capacitor terminal voltage, the first charging/discharging capacitor 111 will not be discharged. On the other hand, a current branches out the first charging/discharging capacitor 111 side and the multi-stage driving circuit side so that the first charging/discharging capacitor 111 is charged with a branched current. For this reason, the LED drive current in this case is $I_{fa}$, which will be smaller than the case where the first charging/discharging capacitor 111 is not provided. That is, even after the capacitor is fully charged, the terminal voltage of the capacitor will reach a voltage $V_{fa}$, which can apply a current of up to $I_{fa}$ to all of the LED portions when the capacitor is discharged at the maximum. As the power supply voltage decreases, when the number of the LED portions is reduced which are driven in the multi-stage driving circuit, the LED terminal voltage will decrease so that operation for discharging the first charging/discharging capacitor 111 will start. The LED terminal voltage is reduced as the number of LED portions is reduced which are driven in the multi-stage driving circuit so that the first charging/discharging capacitor 111 will be discharged at higher current. However, even in this case, this discharging current will not exceed the maximum LED driving current $I_{fa}$ as discussed above.

Thus, the first charging/discharging capacitor 111 can be cyclically discharged in accordance with LED portion driving operation. As a result, the LED portions can be brought ON even in the period where the LED portions are not driven by the sine wave multi-stage drive circuit as shown in FIG. 21. Also, the capacitor can be discharged irrespective of the sine wave multi-stage drive circuit, in other words, without affecting the harmonic distortion suppressing effect and the high power factor. For this reason, the ripple factor of light output can be extremely improved since the light OFF period can be reduced by the additionally-provided sine wave multi-stage drive circuit without affecting the harmonic distortion suppressing effect and the high power factor.

Figure 4:
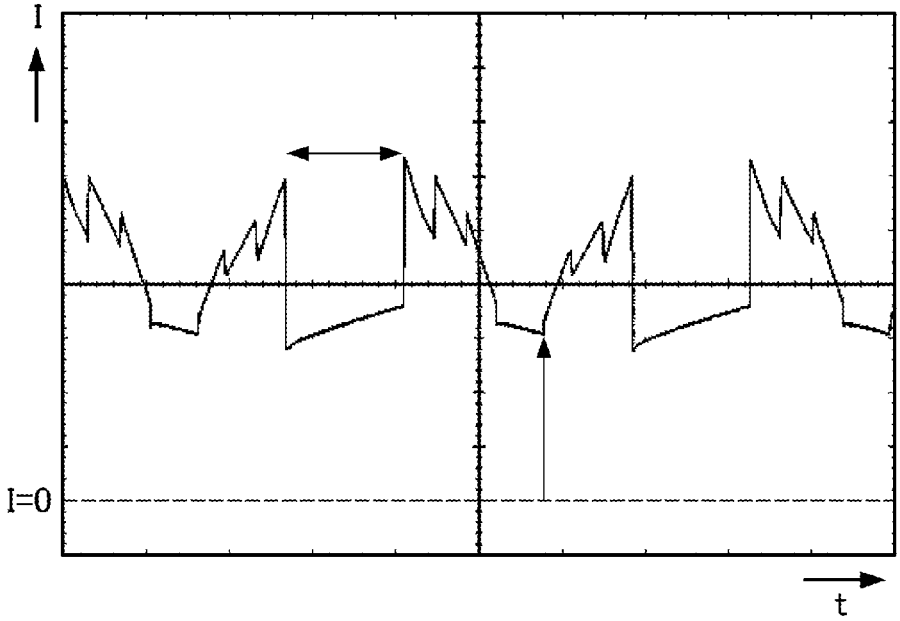
FIG. 4 is a graph showing the current waveform in a first LED portion of the light-emitting diode driving apparatus according to the first embodiment.

FIG. 4 shows the current waveform of the first LED portion in the light-emitting diode driving apparatus according to the first embodiment. FIG. 20 shows the current waveform of the first LED portion in the light-emitting diode driving apparatus 1800 shown in FIG. 18, which has been developed by the applicant, for comparison. In the case of the construction shown in FIG. 18, the first LED portion is brought OFF in the period shown by the arrow in FIG. 20. In this case, the driving waveform of the first LED portion has a waveform substantially close to a sine wave. Contrary to this, according to the first embodiment shown in FIG. 4, the capacitor is charged so that the LED current is reduced in the period where the power supply voltage is brought near to its peak (period shown by the horizontal arrow in FIG. 4), while the capacitor discharging current is increased with the reduction of the current in the LED portion driven by the sine wave multi-stage driving circuit (shown by the vertical arrow in FIG. 4). Accordingly, the first LED portion can be kept ON to provide light output even in the period where the first LED portion is brought OFF in conventional light-emitting diode driving apparatuses. As a result, it can be seen that the period is eliminated where the LED portions are completely brought OFF. Since the reduced amount in the peak period of current is thus used in the period where the LED portions are brought OFF in conventional light-emitting diode driving apparatuses, it is possible to smooth the light amount and to provide high quality LED portion light emission with reduced flicker.

Figure 5:
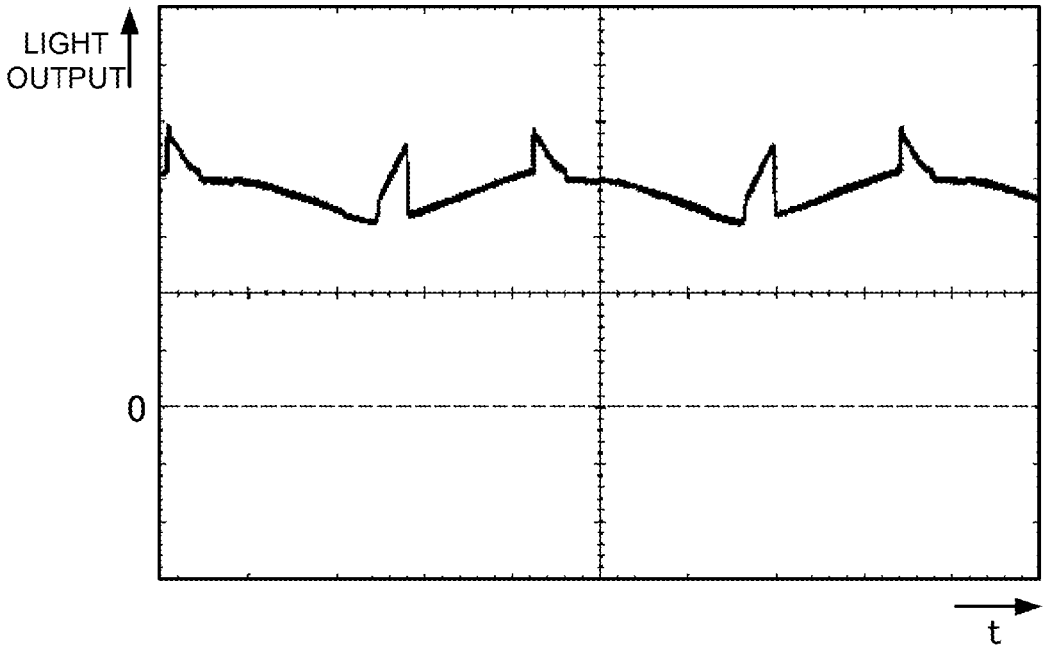
FIG. 5 is a graph showing the waveform of light output measured in the light-emitting diode driving apparatus according to the first embodiment.

FIG. 5 is a graph showing the waveform of light output measured in the apparatus according to the first embodiment. As seen from this graph, the ratio of the smallest light output can be improved to about 60% relative to the peak light output. The ripple factor in the first embodiment can be 0.6 or less, which is better than the ripple factor of the fluorescent light. Therefore, it can be confirmed that the light emission quality is greatly improved.

According to this construction, although the first charging/discharging capacitor 111 with a large capacitance is provided, a large amount of inrush current can be prevented by sine wave current driving operation that provides the first charging/discharging capacitor 111 with a charging current that is obtained by subtracting a current for driving the LED unit 10 from a sine wave current. In addition, since the capacitor charging current is controlled by the sine wave current driving operation, the capacitor ripple current can be very small as compared with quick charge operation. For this reason, although it is said that aluminum electrolytic capacitors have shorter life as compared with LED devices, even in the case where an aluminum electrolytic capacitor is used as the first charging/discharging capacitor 111, it is possible to surely provide a light-emitting diode driving apparatus with long life. Therefore, it is possible to improve the quality and reliability of the light-emitting diode driving apparatus.

Second Embodiment

Figure 6:
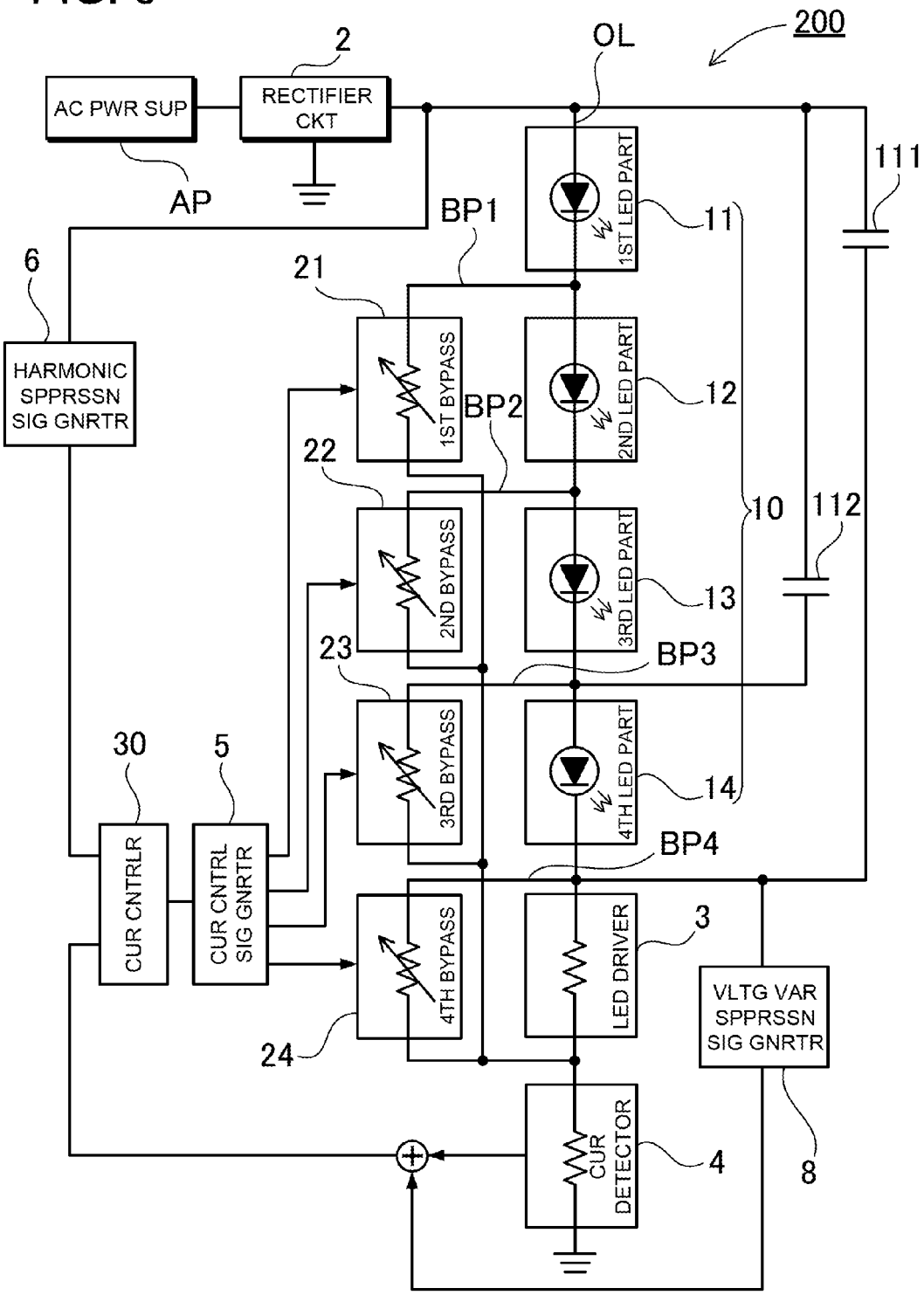
FIG. 6 is a block diagram showing a light-emitting diode driving apparatus according to a second embodiment.
Figure 7A:
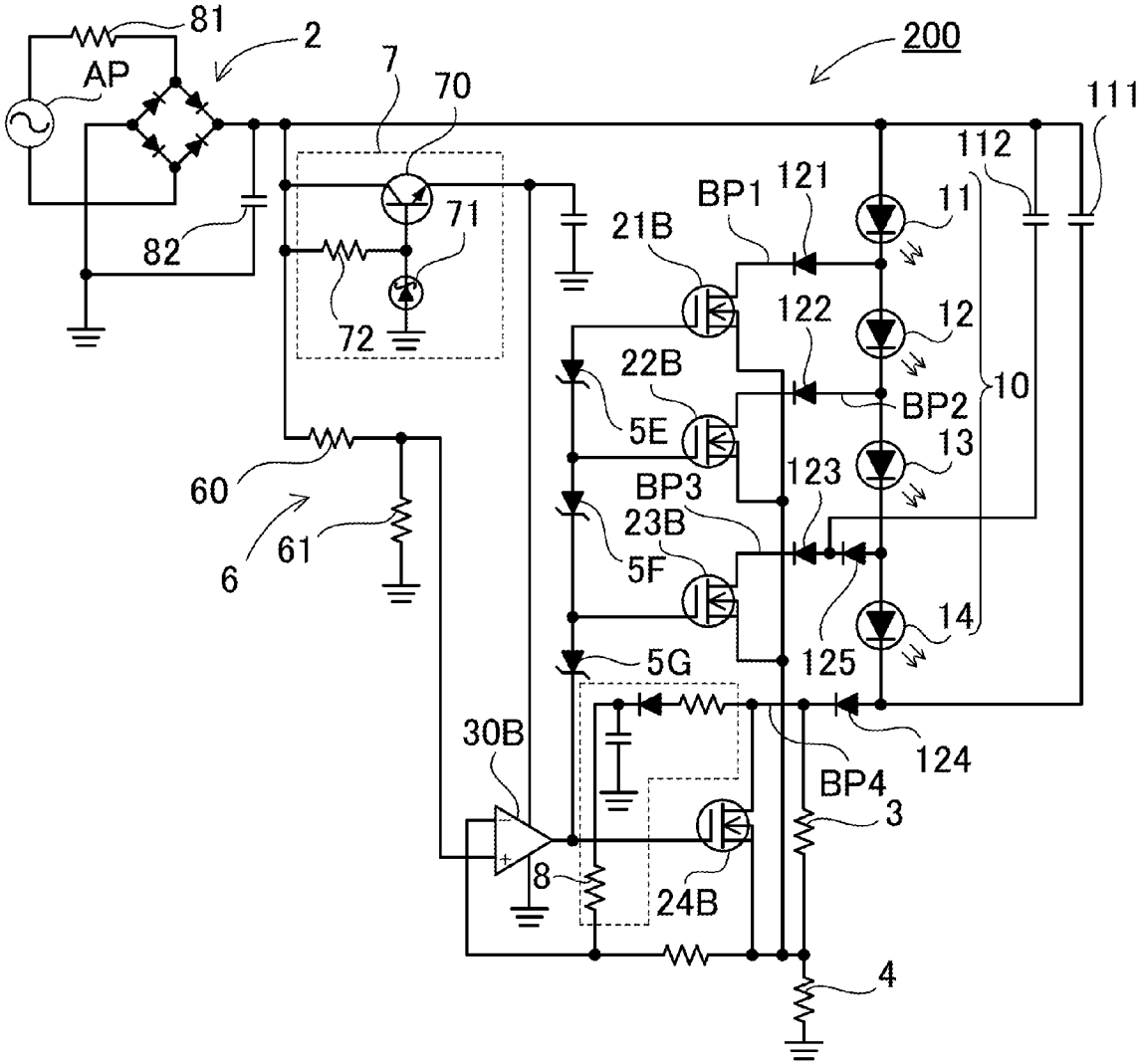
FIG. 7A is a circuit diagram showing an exemplary circuit of the light-emitting diode driving apparatus shown in FIG. 6.
Figure 8:
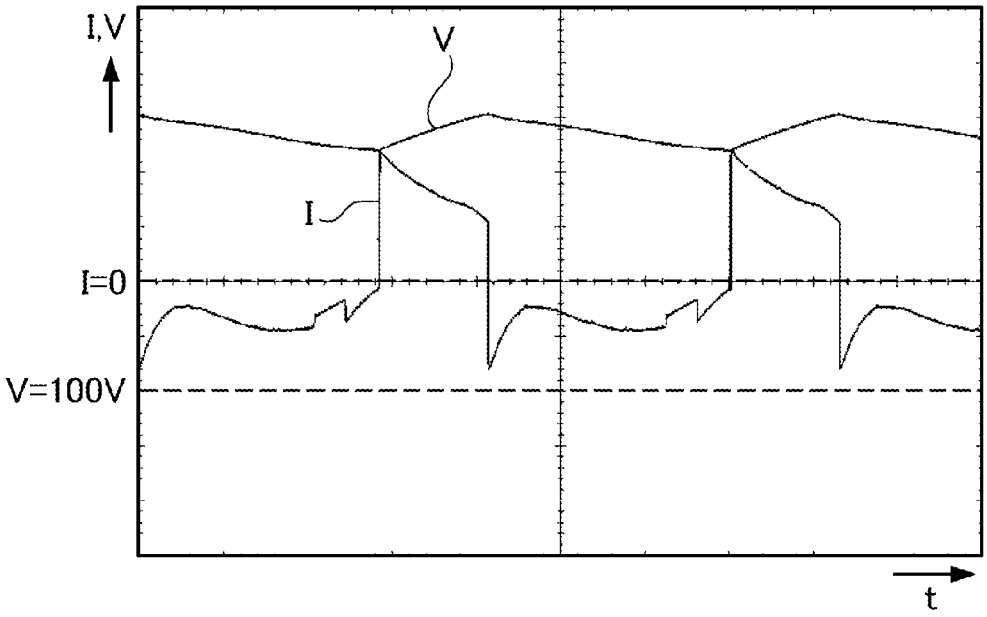
FIG. 8 is a graph showing the current and the voltage waveform of a first charging/discharging capacitor in the light-emitting diode driving apparatus according to the second embodiment.
Figure 9:
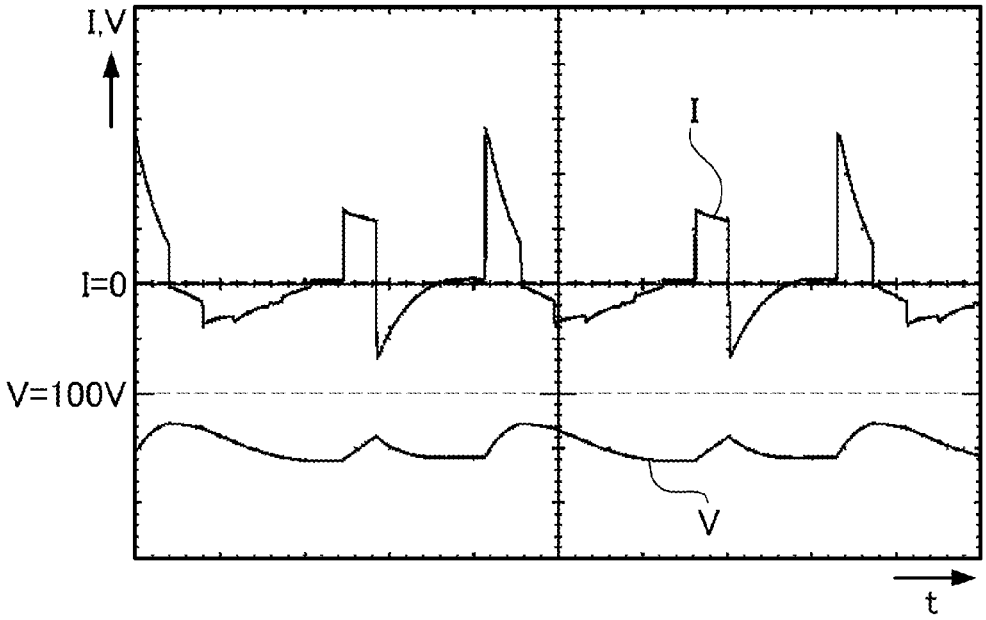
FIG. 9 is a graph showing the current and the voltage waveform of a second charging/discharging capacitor in the light-emitting diode driving apparatus according to the second embodiment.

In the foregoing embodiment, it has been described that one first charging/discharging capacitor 111 is connected as the smoothing circuit. However, the present invention is not limited to this. A plurality of capacitors can be connected to further improve the waveform improvement effect. A light-emitting diode driving apparatus 200 according to a second embodiment includes a plurality of capacitors. FIG. 6 is a block diagram of the light-emitting diode driving apparatus 200, which additionally includes a second charging/discharging capacitor 112 connected as the smoothing circuit. FIG. 7A is a diagram showing an exemplary specific circuit of the light-emitting diode driving apparatus 200. FIG. 8 shows the current and voltage waveforms of the first charging/discharging capacitor 111 in this exemplary circuit. FIG. 9 shows the current and voltage waveforms of the second charging/discharging capacitor 112. The second charging/discharging capacitor 112 is connected in parallel to the first LED portion 11, and in series to the fourth LED portion 14. A current waveform of the light-emitting diode driving apparatus 200 is the same as a current waveform shown in FIG. 19.

Figure 7B:
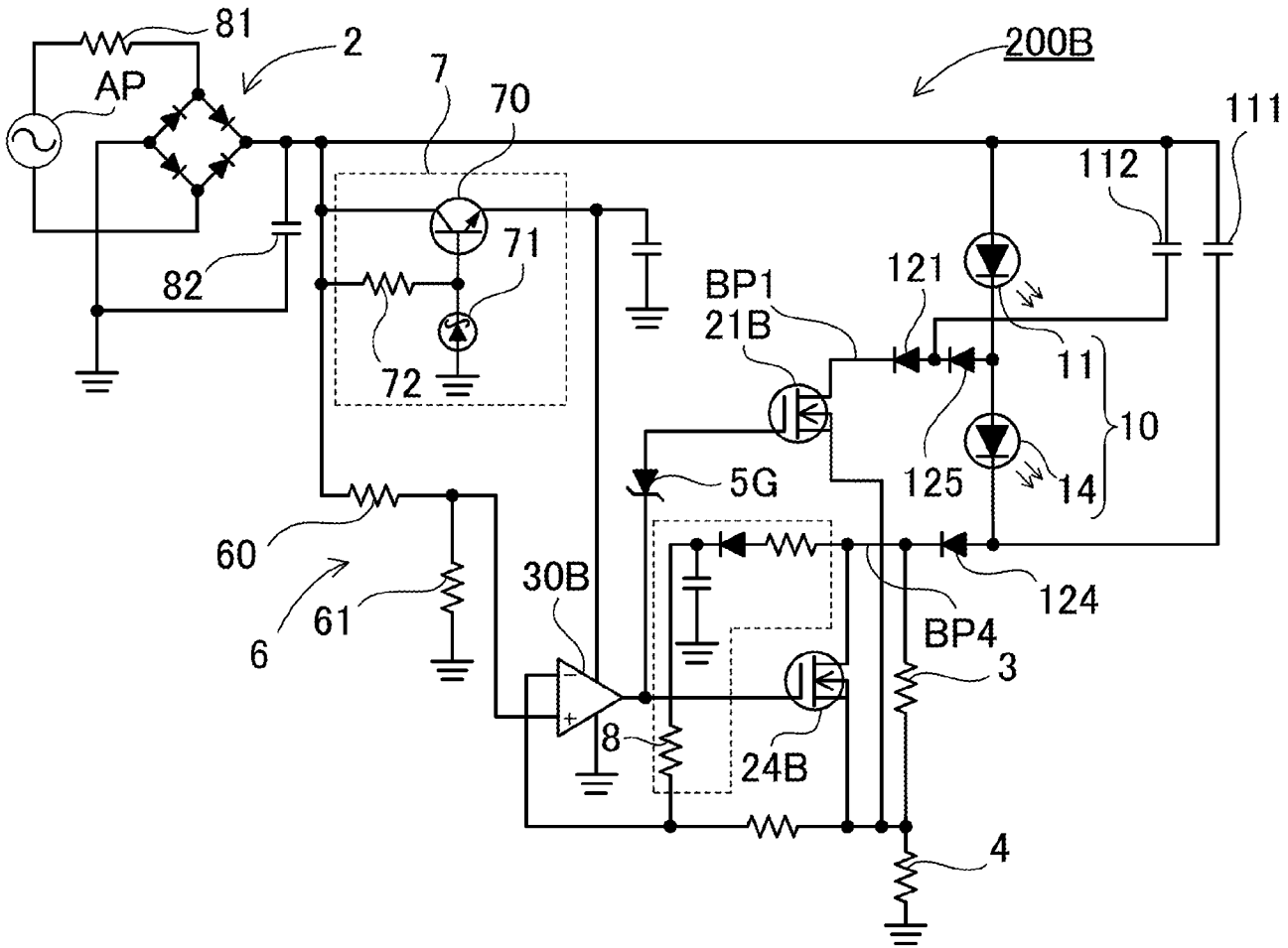
FIG. 7B is a circuit diagram showing an exemplary circuit of the light-emitting diode driving apparatus shown in FIG. 1B.

In the light-emitting diode driving apparatus 200 shown in FIG. 7A, the second charging/discharging capacitor 112 and the second discharge diode 125 are additionally provided to the light-emitting diode driving apparatus 100 shown in FIG. 2. Other members in the light-emitting diode driving apparatus 200 are substantially the same as the light-emitting diode driving apparatus 100 shown in FIG. 2, and their description is omitted for the sake of brevity. For the sake of simplicity, FIG. 7B shows a light-emitting diode driving apparatus 200B that includes two LED portions as the first and fourth LED portions 11 and 14, and the first and fourth bypass portions 21 and 24. The first and fourth bypass portions 21 and 24 control light emission of the two LED portions. The illustrated light-emitting diode driving apparatus 200B includes the first and fourth bypass portions 21 and 24, and the first and second charging/discharging capacitors 111 and 112. The first bypass portion 21 is connected in series to the first LED portion 11. The first bypass portion 21 is connected in parallel to the fourth LED portion 14 relative to the first LED portion 11, and controls the flowing current amount in the first LED portion 11. The fourth bypass portion 24 is connected in series to the fourth LED portion 14, and controls the flowing current amount in the first and fourth LED portions 11 and 14. The first charging/discharging capacitor 111 is connected in parallel to the in-series connection member of the first and fourth LED portions 11 and 14. The second charging/discharging capacitor 112 is connected in parallel to the first LED portion 11 and in series to the fourth LED portion 14. The first charging/discharging capacitor 111 is charged if the rectified voltage is greater than the sum of the forward voltages of the first and fourth LED portions 11 and 14. The first charging/discharging capacitor is discharged if the rectified voltage is smaller than the sum of the forward voltages of the first and fourth LED portions 11 and 14. The second charging/discharging capacitor 112 is charged if the rectified voltage is greater than the forward voltage of the first LED portion 11, while the second charging/discharging capacitor is discharged if the rectified voltage is smaller than the forward voltage of the first LED portion 11. According to this construction, it is possible to suppress the ripple of output light. Therefore, it is possible to provide quality light emission. Since the second charging/discharging capacitor 112 is further provided in addition to the first charging/discharging capacitor 111 so that the second charging/discharging capacitor 112 can be charged even in the period where the first charging/discharging capacitor is not charged, it is possible to suppress a sharp rise in the LED current waveform. As a result, it is possible to bring the light output waveform close to a smooth waveform. In particular, the second charging/discharging capacitor 112 is used to be charged when the rectified voltage applied to the second LED portion 12 becomes high so that the charged electric charge is discharged to apply a current to the second LED portion 12 when the rectified voltage becomes low. As a result, it is possible to reduce the difference of the current amount in the second LED portion 12. Therefore, it is possible to improve the ripple factor. In addition, since the first bypass portion 21 is provided on the charging path, an inrush current into the second charging/discharging capacitor 112 can be suppressed. Therefore, it is possible to prevent power factor reduction.

As shown in FIG. 7A, the second discharge diode 125 composes the discharging path through which the discharging current flows from the second charging/discharging capacitor 112 to the first to third LED portions 11 to 13. Also, the second discharge diode prevents the charging current for charging the second charging/discharging capacitor 112 from flowing into the fourth LED portion 14. The second discharge diode 125 is connected in series to the third backflow-preventing diode 123. One end of the second charging/discharging capacitor 112 is connected between the second discharge diode and the third backflow-preventing diode. The second charging/discharging capacitor 112 is connected through the third backflow-preventing diode 123 to the third LED current control transistor 23B, which is the third bypass portion. Since the second charging/discharging capacitor 112 is charged only in the period where a current is controlled by the third LED current control transistor 23B, it is possible to more effectively suppress the ripple of the light output.

(Operation for Charging Second Charging Capacitor 112)

The second charging/discharging capacitor 112 is charged through the power supply line, the second charging/discharging capacitor 112, the third backflow-preventing diode 123, and the third LED current control transistor 23B. This charging operation is performed when the light emission of the first, second and third LED portions 11, 12 and 13 is controlled by the third LED current control transistor 23B. The second charging/discharging capacitor is charged with a charging current so that the capacitor terminal voltage will be equal to the sum of $V_f$ values of the first to third LED portions. On the other hand, this charging current is superposed on the LED current, which flows in the first to third LED portions. The third current control transistor 23B controls the superposed current so that the superposed current approximates a sine wave. Thus, the second charging/discharging capacitor 112 can be charged without affecting the harmonic distortion suppression function that is provided by the exemplary circuit 1800 of FIG. 18.

The amount of LED current is reduced by the amount of capacitor charging current in the period where the capacitor is charged. In the exemplary circuit of FIG. 7A, the third LED current control transistor 23B adjusts a current to a sine wave current in the period where the LEDs in the first to third LED portions 11 to 13 are brought ON. In the case of the exemplary circuit shown in FIG. 2, the light output will be its peak in this period in FIG. 5. If the LED current can be reduced in this period, the maximum light output can be suppressed. As a result, it is possible to reduce the ripple factor. To achieve this, the second charging/discharging capacitor 112 is charged in this period so that the maximum light output is suppressed. The electric power is stored in the capacitor, and is then discharged when the power supply voltage is low so that light output is provided. In this case, it is possible to provide both the ripple factor improvement effects.

(Operation for Discharging Second Charging/Discharging Capacitor 112)

The operation for discharging the second charging/discharging capacitor 112 is now described. In the light-emitting diode driving apparatus 200 shown in FIG. 7A, the discharging circuit for discharging the second charging/discharging capacitor 112 is constructed of the first to third LED portions 11 to 13. The discharging current does not flow in the sine wave multi-stage drive circuit. Accordingly, the discharging current does not affect the operation of the sine wave multi-stage drive circuit. By the similar reason to the operation for discharging the first charging/discharging capacitor 111 as discussed, an excess amount of current will not flow into LEDs.

Figure 10:
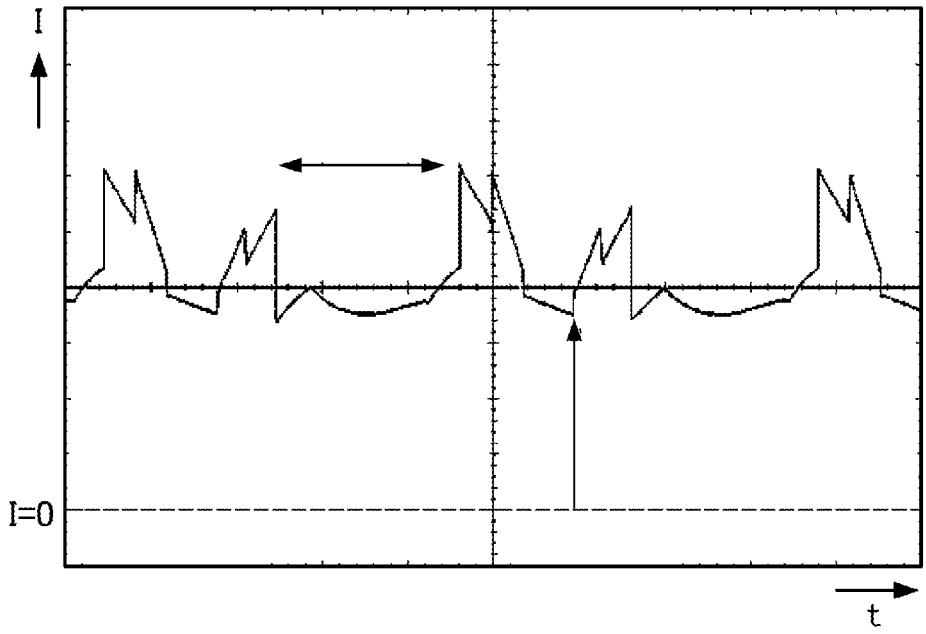
FIG. 10 is a graph showing the current waveform of a first LED portion of the light-emitting diode driving apparatus according to the second embodiment.

FIG. 10 shows the current waveform of the first LED portion 11 in the light-emitting diode driving apparatus 200 according to the second embodiment. The current waveform of the first LED portion according to the second embodiment is now compared with the current waveform of the first LED portion 11 in the light-emitting diode driving apparatus 100 according to the first embodiment shown in FIG. 4. In the case of the first embodiment shown in FIG. 2, in the period where the first to third LED portions 11 to 13 are brought ON, the light output has its peak. Contrary to this, according to the second embodiment shown in FIG. 10, the second charging/discharging capacitor 112 is charged so that the LED current is reduced in the period where the power supply voltage is brought near to its peak (period shown by the horizontal arrow in FIG. 10), while the capacitor discharging current is increased with the reduction of the current in the LED portion driven by the sine wave multi-stage driving circuit (shown by the vertical arrow in FIG. 10). As a result, it is possible to further improve the ripple factor. In addition, current ripple can be small similar to the first charging/discharging capacitor 111. Even if aluminum electrolytic capacitors are used, the long-life life can be surely provided.

Figure 11:
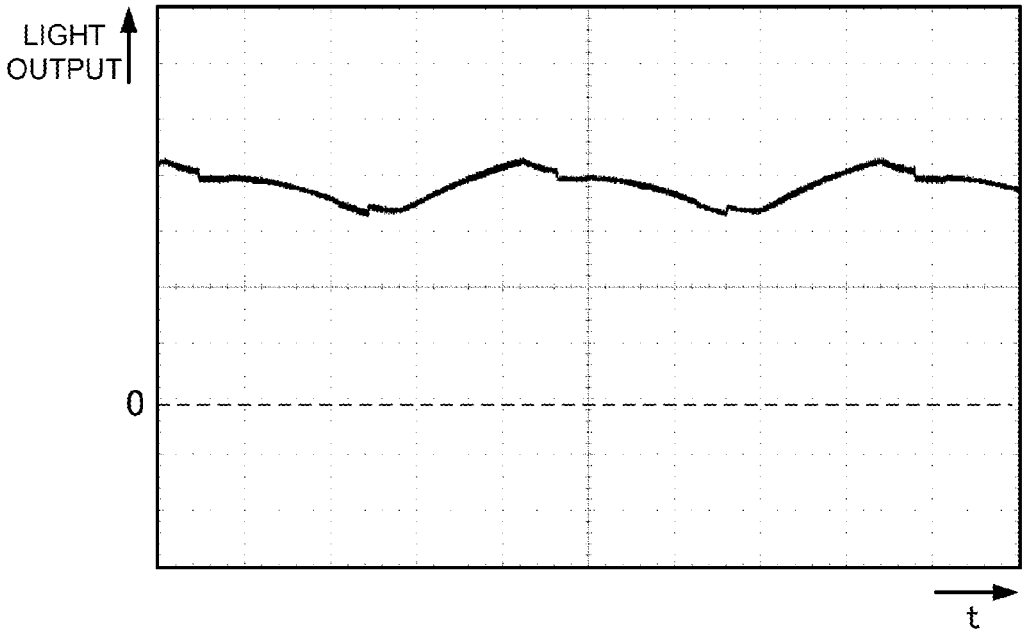
FIG. 11 is a graph showing the waveform of light output measured in the light-emitting diode driving apparatus according to the second embodiment.

FIG. 11 is a graph showing the light output waveform of the light emitting diode driving apparatus 200 according to the second embodiment. From this graph, it can be confirmed that the ripple factor can be reduced as compared with the light output of the first embodiment shown in FIG. 5.

In the case of FIG. 7A, it has been described that the light-emitting diode driving apparatus includes four LED portions as the first to fourth LED portions 11 to 14. However, the present invention is not limited to this construction. As discussed above, the number of the LED portions can be a plural number. For example, the number of the LED portions can be not greater than three, or not smaller than five. For example, in the case where the LED unit is constructed of two LED portions as the first and fourth LED portions 11 and 14 similar to the light-emitting diode driving apparatus 200B shown in FIG. 7B, it is possible to provide an effective AC multi-stage circuit as stated above. The number of the LED portions can be suitably selected depending on required light amount, quality such as crest factor, power consumption, cost, and the like.

Third Embodiment

Figure 12:
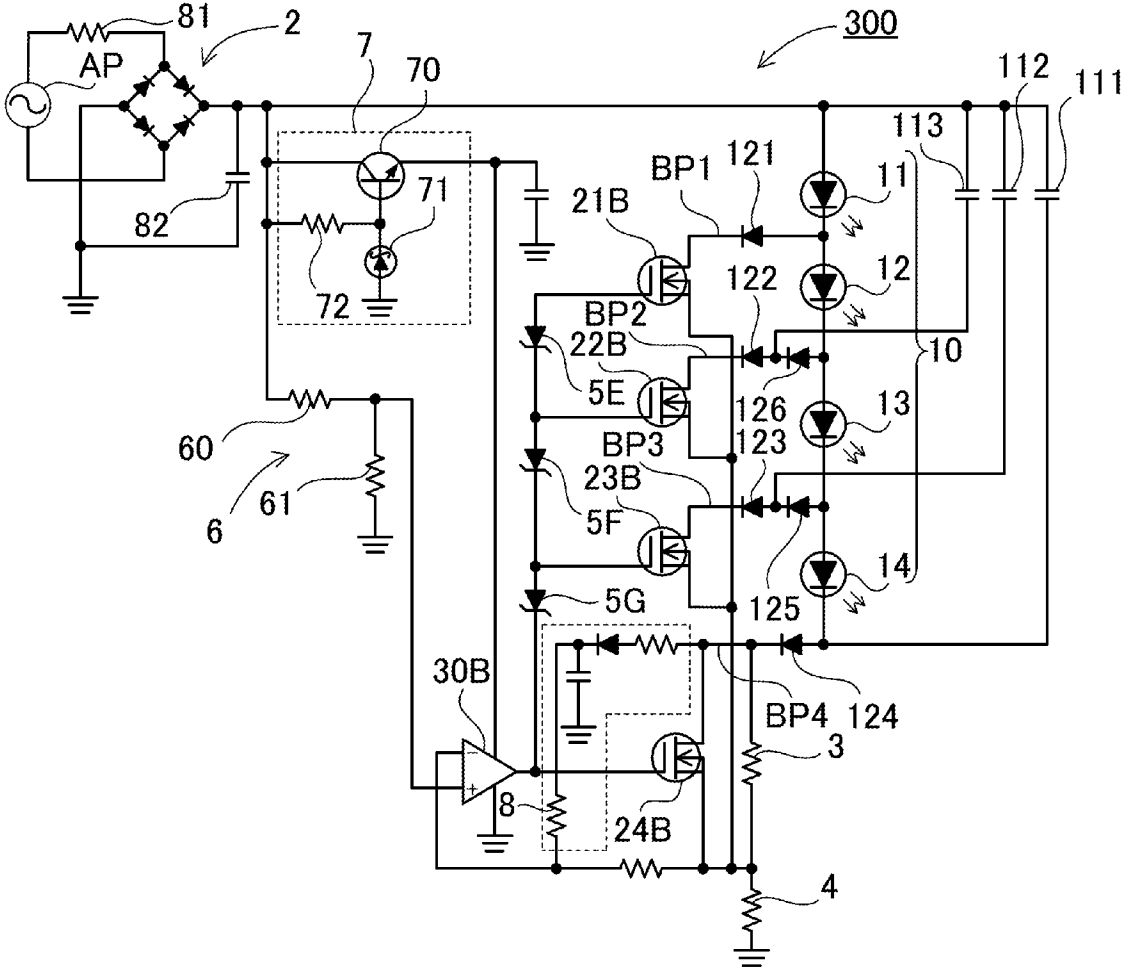
FIG. 12 is a circuit diagram showing an exemplary circuit of the light-emitting diode driving apparatus according to a third embodiment.

The number of the charging/discharging capacitors is not limited to two. Three or more charging/discharging capacitors can be provided. FIG. 12 is a circuit diagram showing a light-emitting diode driving apparatus 300 according to a third embodiment, which includes three charging/discharging capacitors. A third charging/discharging capacitor 113 is additionally connected in parallel to the first and second LED portions 11 and 12 as shown in this diagram. According to this construction, the ripple factor can be improved similar to the first and second embodiments.

In particular, the third charging/discharging capacitor 113 is used to be charged when the rectified voltage applied to the third LED portion becomes high so that the third charging/discharging capacitor is discharged to apply a current to the third LED portion 13 when the rectified voltage becomes low. As a result, it is possible to reduce the difference of the current amount in the third LED portion 13. Therefore, it is possible to improve the ripple factor. In addition, since the second bypass portion 22 is provided on the charging path, an inrush current into the third charging/discharging capacitor 113 can be suppressed. Therefore, it is possible to prevent power factor reduction.

As shown in FIG. 12, the third discharge diode 126 composes the discharging path through which the discharging current flows from the third charging/discharging capacitor 113 to the first and second LED portions 11 and 12. Also, the third discharge diode prevents the charging current for charging the third charging/discharging capacitor 113 from flowing into the third LED portion 13. The third discharge diode 126 is connected in series to the second backflow-preventing diode 122. One end of the third charging/discharging capacitor 113 is connected between the third discharging diode and the second backflow-preventing diode. The third charging/discharging capacitor 113 is connected through the second backflow-preventing diode 122 to the second LED current control transistor 22B, which is the second bypass portion. Since the third charging/discharging capacitor 113 is charged only in the period where a current is controlled by the second LED current control transistor 22B, it is possible to more effectively suppress the ripple of the light output.

Fourth Embodiment

Figure 13:
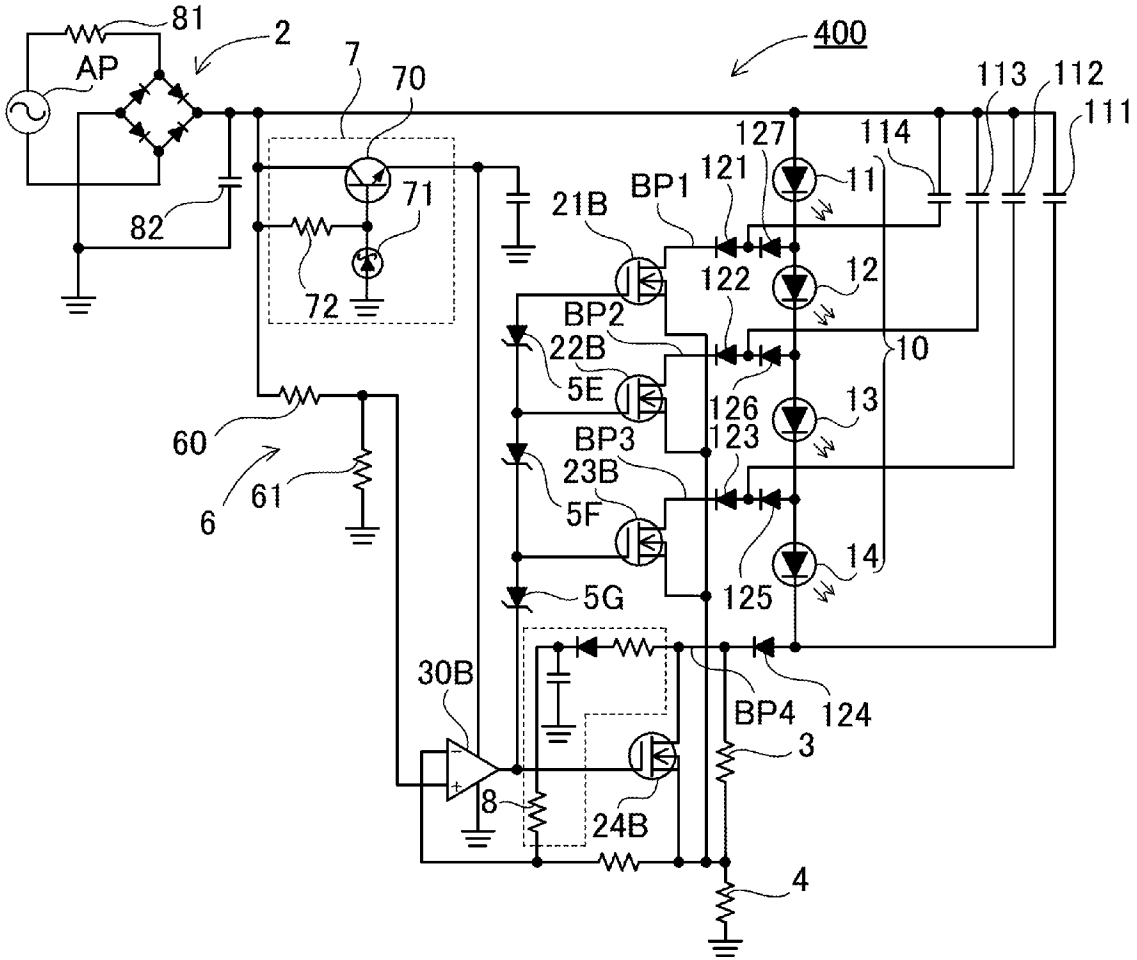
FIG. 13 is a circuit diagram showing an exemplary circuit of the light-emitting diode driving apparatus according to a fourth embodiment.
Figure 14:
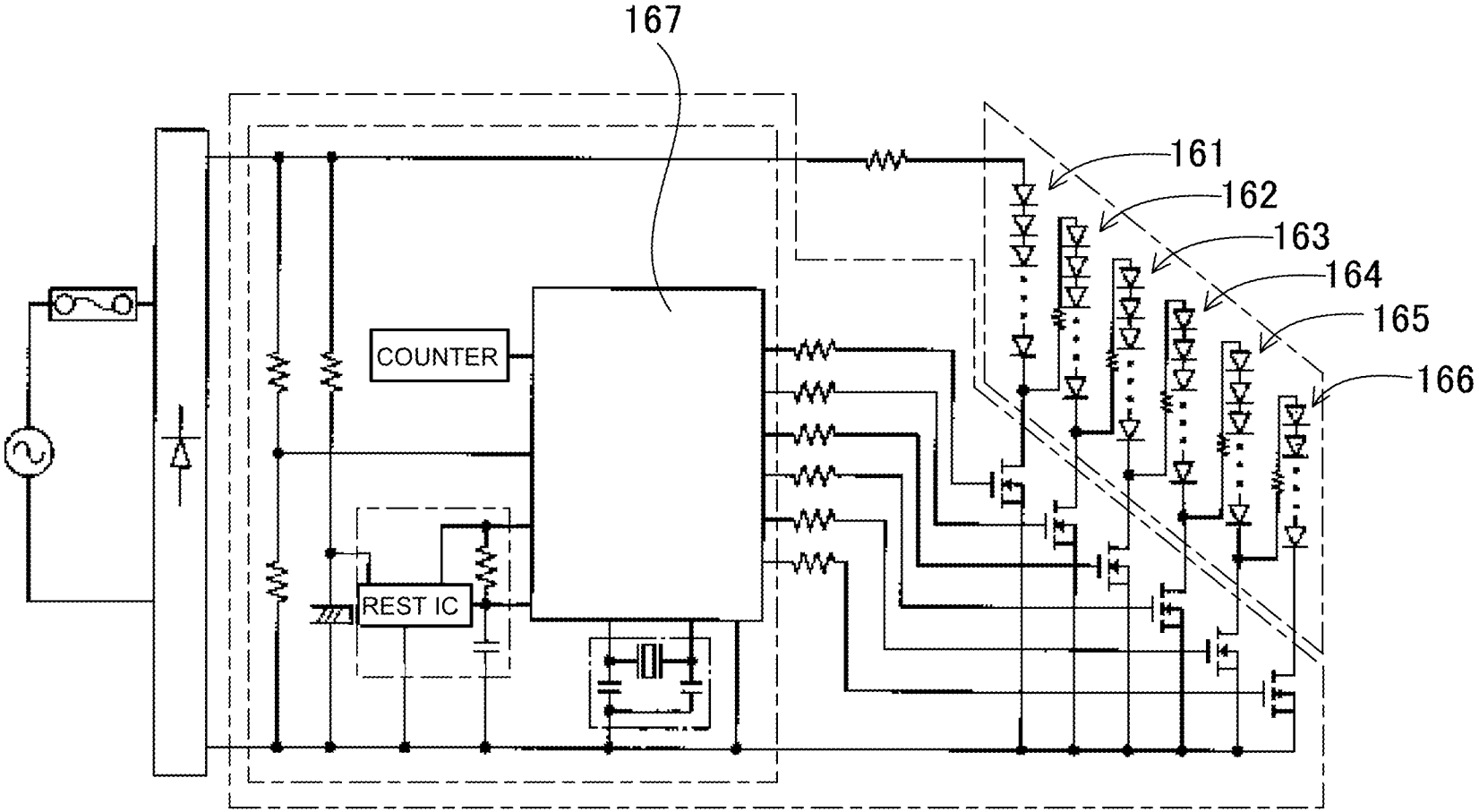
FIG. 14 is a circuit diagram showing an LED driving circuit that includes a microcomputer.
Figure 15:
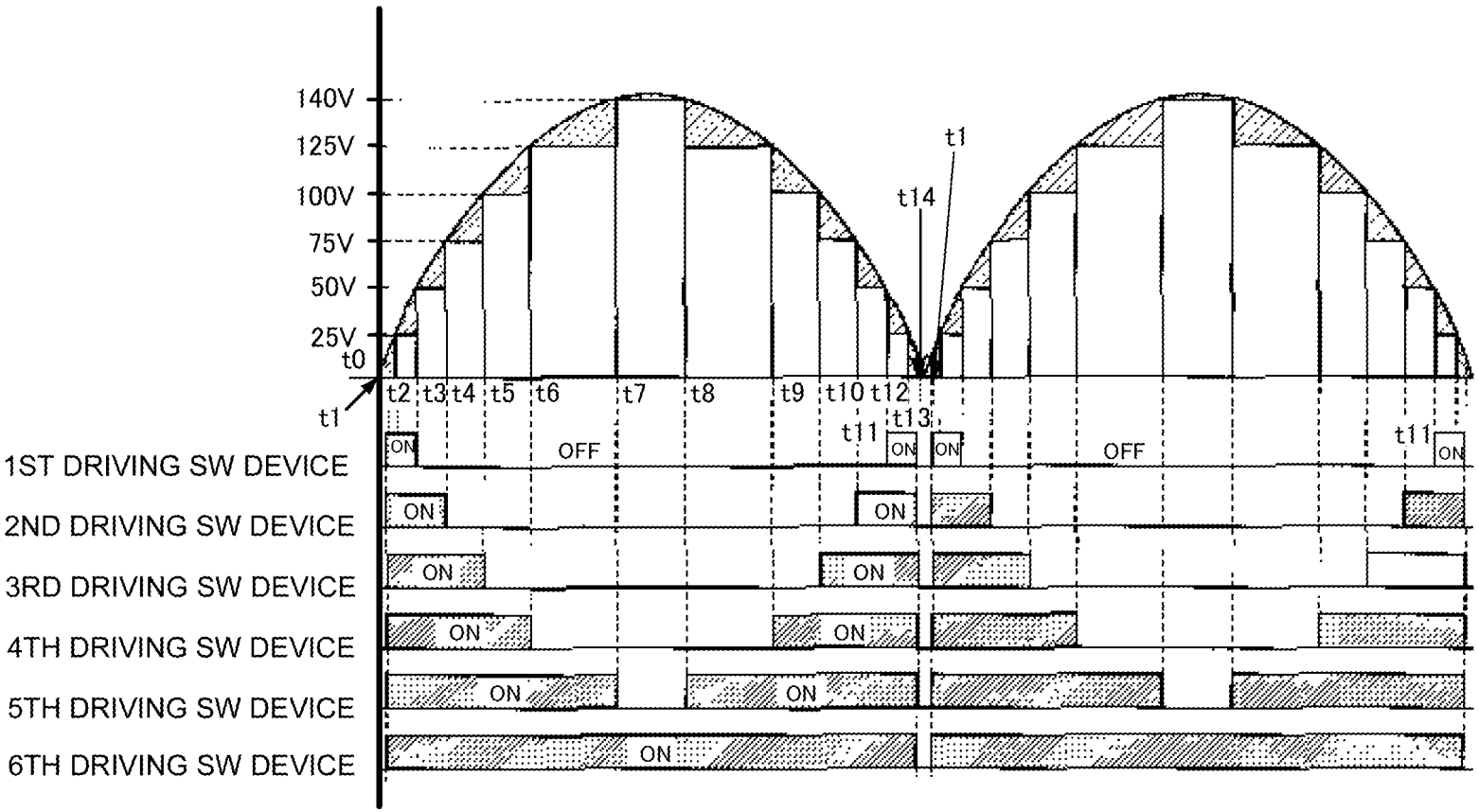
FIG. 15 is a timing chart showing operation of the LED driving circuit shown in FIG. 14.
Figure 16:
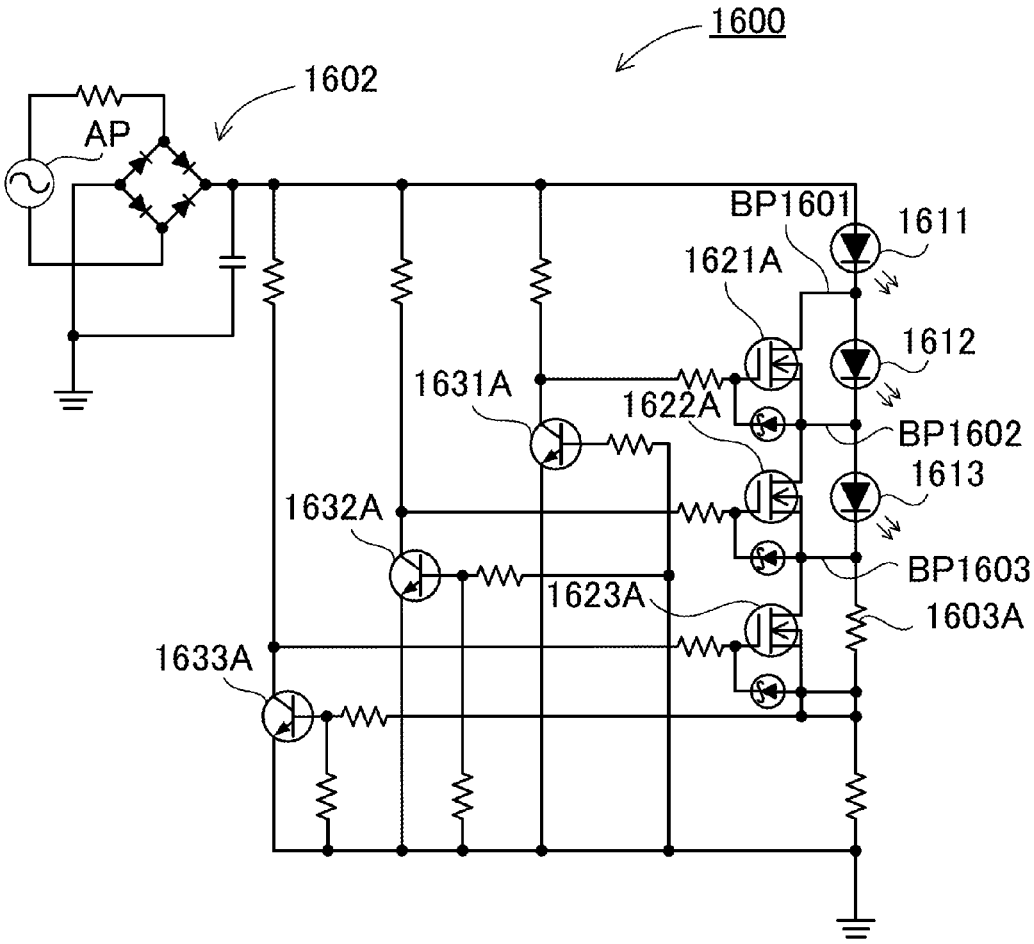
FIG. 16 is a circuit diagram showing a known light-emitting diode driving apparatus.

FIG. 13 is a diagram showing a circuit diagram showing a light-emitting diode driving apparatus 400 according to a fourth embodiment, which includes four charging/discharging capacitors. This diagram is a circuit diagram showing the light-emitting diode driving apparatus 400 according to the fourth embodiment. In this embodiment, the fourth charging/discharging capacitor 114 is additionally connected in parallel to the first LED portion. According to this construction, ripple factor improvement can be expected. A fourth discharge diode 127 composes the discharging path through which the discharging current flows from the fourth charging/discharging capacitor 114 to the first LED portion 11. Also, the fourth discharge diode prevents the charging current for charging the fourth charging/discharging capacitor 114 from flowing into the second LED portion 12. The fourth discharge diode 127 is connected in series to the first backflow-preventing diode 121. One end of the fourth charging/discharging capacitor 114 is connected between the fourth discharge diode and the first backflow-preventing diode. The fourth charging/discharging capacitor 114 is connected through the first backflow-preventing diode 121 to the first LED current control transistor 21B, which is the first bypass portion. Since the fourth charging/discharging capacitor 114 is charged only in the period where a current is controlled by the first LED current control transistor 21B, it is possible to more effectively suppress the ripple of the light output.

The aforementioned light-emitting diode driving apparatus includes LED devices. The LED devices and the driving circuit for driving the LED devices can be mounted on a common circuit board. This light emitting diode driving apparatus can be used as a lighting apparatus driven by AC commercial power for home use.

It should be apparent to those with an ordinary skill in the art that while various preferred embodiments of the invention have been shown and described, it is contemplated that the invention is not limited to the particular embodiments disclosed, which are deemed to be merely illustrative of the inventive concepts and should not be interpreted as limiting the scope of the invention, and which are suitable for all modifications and changes falling within the scope of the invention as defined in the appended claims. The present application is based on Application No. 2012-022,525 filed in Japan on Feb. 3, 2012, the content of which is incorporated herein by reference.

What is claimed is:

1. A light-emitting diode driving apparatus comprising:

a rectifying circuit that can be connected to AC power supply and rectifies an AC voltage of the AC power supply to provide a rectified voltage;

a first LED portion that is connected in series to the output-side of said rectifying circuit, and includes at least one LED device;

a second LED portion that is connected in series to said first LED portion, and includes at least one LED device;

a first bypass portion that is connected in series to said first LED portion and in parallel to said second LED portion, and controls the flowing current amount in said first LED portion;

a fourth bypass portion that is connected in series to said second LED portion, and controls the flowing current amount in said first and second LED portions;

a current detection portion that detects a current detection signal based on the flowing current amount on an output line along which said first and second LED portions are connected in series to each other; and a current control portion that provides an operation control signal for controlling operation of said first and fourth bypass portions based on the current detection signal, which is detected by said current detection portion, wherein said current control portion includes one output for providing said operation control signal, wherein said first and fourth bypass portions are connected in parallel to said one output.

2. The light-emitting diode driving apparatus according to claim 1, wherein said current control portion uses the rectified voltage, which is rectified by said rectifying circuit, as a reference voltage to provide the operation control signal for controlling operation of said first and fourth bypass portions.

3. The light-emitting diode driving apparatus according to claim 1 further comprising a voltage variation suppression signal generation portion that is connected in series to the in-series circuit of said first and second LED portions, and detects rectified voltage variation, wherein said current control portion controls operation of said first and fourth bypass portions based on the sum of the average value of the rectified voltage variation, which is detected by said voltage variation suppression signal generation portion, and the current detection signal, which is detected by said current detection portion.

4. The light-emitting diode driving apparatus according to claim 1 further comprising a first charging/discharging capacitor that is connected in parallel to the in-series circuit of said first and second LED portions.

5. The light-emitting diode driving apparatus according to claim 1 further comprising a third LED portion that is connected to said second LED portion, and includes at least one LED device, and a second bypass portion that is connected in series to said second LED portion and in parallel to said third LED portion, and controls the flowing current amount in said first and second LED portions, wherein said first, second and fourth bypass portions are connected in parallel to each other, wherein the operation of said second bypass portion is controlled by said current control portion, wherein said fourth bypass portion controls the flowing current amount in first, second and third LED portions.

6. The light-emitting diode driving apparatus according to claim 1, wherein said current control portion includes an operational amplifier.

7. The light-emitting diode driving apparatus according to claim 1 further comprising an LED driving portion that is connected in series to said second LED portion, and controls the current flow in said first and second LED portions, wherein said fourth bypass portion is connected in parallel to said LED driving portion.

8. The light-emitting diode driving apparatus according to claim 1, wherein said current control portion is capable of be driven with constant-voltage power supply.

9. The light-emitting diode driving apparatus according to claim 1, wherein current control signal generation portions are connected between said current control portion and the first bypass portion, and between the current control portion and the fourth bypass portion.

10. The light-emitting diode driving apparatus according to claim 9, wherein said current control signal generation portion is a Zener diode or a resistor.

* * * * *